US008369743B2

(12) United States Patent
Maeshima et al.

(10) Patent No.: US 8,369,743 B2
(45) Date of Patent: Feb. 5, 2013

(54) PROCESS CARTRIDGE AND ELECTROPHOTOGRAPHIC IMAGE FORMING APPARATUS

(75) Inventors: Hideki Maeshima, Mishima (JP); Kazunari Murayama, Numazu (JP); Akira Yoshimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 716 days.

(21) Appl. No.: 12/164,774

(22) Filed: Jun. 30, 2008

(65) Prior Publication Data

US 2009/0003876 A1 Jan. 1, 2009

(30) Foreign Application Priority Data

Jun. 29, 2007 (JP) ..... 2007-172743
Jun. 20, 2008 (JP) ..... 2008-162312

(51) Int. Cl.
*G03G 21/16* (2006.01)

(52) U.S. Cl. ..... 399/111

(58) Field of Classification Search ..... 399/111, 399/113

See application file for complete search history.

(56) References Cited

U.S. PATENT DOCUMENTS

| | | | | |
|---|---|---|---|---|
| 5,283,616 | A | 2/1994 | Numagami et al. | 355/245 |
| 5,367,363 | A | 11/1994 | Kai et al. | |
| 5,500,714 | A | 3/1996 | Yashiro et al. | 355/200 |
| 5,543,898 | A | 8/1996 | Shishido et al. | 355/210 |
| 5,585,895 | A | 12/1996 | Yashiro et al. | 355/215 |
| 5,617,579 | A | 4/1997 | Yashiro et al. | 399/114 |
| 5,619,309 | A | 4/1997 | Yashiro et al. | 399/111 |
| 5,638,161 | A | 6/1997 | Numagami et al. | 399/111 |
| 5,652,647 | A | 7/1997 | Yashiro et al. | 399/111 |
| 5,689,774 | A | 11/1997 | Shishido et al. | 399/111 |
| 5,768,658 | A | 6/1998 | Watanabe et al. | 399/111 |

(Continued)

FOREIGN PATENT DOCUMENTS

| | | |
|---|---|---|
| EP | 1 519 248 A1 | 3/2005 |
| EP | 1 621 942 A2 | 2/2006 |

(Continued)

OTHER PUBLICATIONS

PCT International Search Report and Written Opinion of International Search Authority in PCT/JP2008/062251 issued Nov. 24, 2008.

(Continued)

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

A process cartridge is provided for detachably mounting to a main assembly of an electrophotographic image forming apparatus. The process cartridge includes an electrophotographic photosensitive drum, a developing roller for developing an electrostatic latent image formed on the electrophotographic photosensitive drum, a drum unit containing the electrophotographic photosensitive drum, and a developing unit which contains the developing roller and which is movable relative to the drum unit such that developing roller is movable between a contact position in which the developing roller is contacted to the electrophotographic photosensitive drum and a spaced position in which the developing roller is spaced from the electrophotographic photosensitive drum. The process cartridge also includes a force receiving member capable of taking an operating position for moving the developing frame from the contacting position to the spacing position by receiving an external force, and a stand-by position retracted from the operating position.

24 Claims, 34 Drawing Sheets

U.S. PATENT DOCUMENTS

| | | | | |
|---|---|---|---|---|
| 5,790,923 | A | 8/1998 | Oguma et al. | 399/106 |
| 5,920,753 | A | 7/1999 | Sasaki et al. | 399/111 |
| 5,937,239 | A | 8/1999 | Watanabe et al. | 399/111 |
| 5,937,242 | A | 8/1999 | Yokoyama et al. | 399/114 |
| 5,953,560 | A | 9/1999 | Numagami et al. | 399/111 |
| 5,966,566 | A | 10/1999 | Odagawa et al. | 399/109 |
| 5,966,568 | A | 10/1999 | Numagami et al. | 399/111 |
| 6,006,058 | A | 12/1999 | Watanabe et al. | 399/167 |
| 6,016,413 | A | 1/2000 | Yokoyama et al. | 399/113 |
| 6,029,032 | A | 2/2000 | Watanabe et al. | 399/111 |
| 6,064,842 | A | 5/2000 | Takeuchi et al. | 399/111 |
| 6,097,908 | A | 8/2000 | Uchiyama et al. | 399/111 |
| 6,097,909 | A | 8/2000 | Watanabe et al. | 399/111 |
| 6,101,354 | A | 8/2000 | Nakagawa et al. | 399/225 |
| 6,118,960 | A | 9/2000 | Nakagawa et al. | 399/111 |
| 6,131,007 | A | 10/2000 | Yamaguchi et al. | 399/256 |
| 6,157,792 | A | 12/2000 | Mori et al. | 399/24 |
| 6,169,866 | B1 | 1/2001 | Watanabe et al. | 399/111 |
| 6,246,849 | B1 | 6/2001 | Yokoyama et al. | 399/117 |
| 6,266,500 | B1 | 7/2001 | Numagami et al. | 399/104 |
| 6,272,299 | B1 | 8/2001 | Numagami et al. | 399/111 |
| 6,289,189 | B1 | 9/2001 | Numagami et al. | 399/111 |
| 6,308,028 | B1 | 10/2001 | Yashiro et al. | 399/111 |
| 6,330,409 | B1 | 12/2001 | Watanabe et al. | 399/111 |
| 6,385,416 | B1 | 5/2002 | Horikawa et al. | 399/111 |
| 6,408,142 | B1 | 6/2002 | Takeuchi et al. | 399/13 |
| 6,442,359 | B1 | 8/2002 | Numagami et al. | 399/111 |
| 6,459,869 | B2 | 10/2002 | Nittani et al. | 399/111 |
| 6,463,233 | B2 | 10/2002 | Kojima et al. | 399/111 |
| 6,463,234 | B2 | 10/2002 | Arimitsu et al. | 399/113 |
| 6,577,831 | B1 | 6/2003 | Numagami et al. | 399/111 |
| 6,608,980 | B2 | 8/2003 | Murayama et al. | 399/111 |
| 6,681,088 | B2 | 1/2004 | Kanno et al. | 399/111 |
| 6,714,752 | B2 | 3/2004 | Ueno et al. | 399/117 |
| 6,823,153 | B2 | 11/2004 | Ueno et al. | 399/103 |
| 6,829,455 | B2 | 12/2004 | Yasumoto et al. | 399/167 |
| 6,834,171 | B2 | 12/2004 | Nittani et al. | 399/103 |
| 6,898,391 | B2 | 5/2005 | Numagami et al. | 399/90 |
| 6,912,365 | B2 | 6/2005 | Ueno et al. | 399/25 |
| 6,947,686 | B2 | 9/2005 | Kawai et al. | 399/111 |
| 6,954,601 | B2 | 10/2005 | Numagami et al. | 399/90 |
| 6,968,142 | B2 | 11/2005 | Arimitsu et al. | 399/114 |
| 6,978,099 | B2 | 12/2005 | Ueno et al. | 399/103 |
| 6,980,758 | B2 | 12/2005 | Murayama et al. | 399/111 |
| 6,980,759 | B2 | 12/2005 | Kanno et al. | |
| 6,990,302 | B2 | 1/2006 | Toba et al. | 399/114 |
| 7,046,942 | B2 | 5/2006 | Arimitsu et al. | 399/114 |
| 7,072,594 | B2 | 7/2006 | Hoshi et al. | 399/27 |
| 7,072,602 | B2 | 7/2006 | Hatori et al. | |
| 7,072,603 | B2 | 7/2006 | Tsuzuki et al. | 399/111 |
| 7,088,939 | B2 | 8/2006 | Maeshima et al. | 399/111 |
| 7,092,658 | B2 | 8/2006 | Yasumoto et al. | 399/167 |
| 7,127,194 | B2 | 10/2006 | Hoshi et al. | 399/111 |
| 7,158,735 | B2 | 1/2007 | Murayama et al. | 399/111 |
| 7,158,736 | B2 | 1/2007 | Sato et al. | 399/111 |
| 7,162,174 | B2 | 1/2007 | Suzuki et al. | 399/64 |
| 7,184,682 | B2 | 2/2007 | Chadani et al. | |
| 7,184,690 | B2 | 2/2007 | Ueno et al. | 399/117 |
| 7,194,225 | B2 | 3/2007 | Yamaguchi | |
| 7,209,682 | B2 | 4/2007 | Numagami et al. | 399/167 |
| 7,212,768 | B2 | 5/2007 | Numagami e | 399/111 |
| 7,215,909 | B2 | 5/2007 | Nittani et al. | 399/222 |
| 7,272,339 | B2 | 9/2007 | Tsuzuki et al. | 399/111 |
| 7,298,990 | B2 | 11/2007 | Nishimura | |
| 7,319,827 | B2 | 1/2008 | Yoshizawa | 399/12 |
| 7,319,834 | B2 | 1/2008 | Yamaguchi | |
| 7,340,197 | B2 | 3/2008 | Murayama et al. | 399/111 |
| 7,346,293 | B2 | 3/2008 | Suzuki et al. | 399/111 |
| 7,349,649 | B2 | 3/2008 | Hoshi et al. | 399/111 |
| 7,463,844 | B2 | 12/2008 | Hashimoto et al. | |
| 7,477,865 | B2 | 1/2009 | Yamaguchi | |
| 7,509,071 | B2 | 3/2009 | Yoshimura et al. | |
| 7,835,665 | B2 * | 11/2010 | Okabe et al. | 399/113 |
| 7,890,012 | B2 | 2/2011 | Koishi et al. | |
| 7,986,897 | B2 * | 7/2011 | Nishimura | 399/90 |
| 2003/0142991 | A1 | 7/2003 | Arimitsu et al. | |
| 2003/0156848 | A1 | 8/2003 | Kawai et al. | |
| 2005/0047821 | A1 | 3/2005 | Murayama et al. | 399/111 |
| 2005/0260011 | A1 | 11/2005 | Murayama et al. | 399/111 |
| 2005/0265746 | A1 * | 12/2005 | Jung et al. | 399/111 |
| 2006/0067734 | A1 * | 3/2006 | Igarashi et al. | 399/119 |
| 2006/0177231 | A1 | 8/2006 | Mori et al. | 399/12 |
| 2006/0245785 | A1 | 11/2006 | Kawamura et al. | 399/111 |
| 2006/0257164 | A1 | 11/2006 | Hoshi et al. | 399/111 |
| 2007/0071495 | A1 * | 3/2007 | Hashimoto et al. | 399/111 |
| 2007/0092286 | A1 | 4/2007 | Suzuki et al. | 399/90 |
| 2007/0098438 | A1 * | 5/2007 | Yamaguchi | 399/111 |
| 2007/0110478 | A1 | 5/2007 | Numagami et al. | 399/167 |
| 2007/0147890 | A1 | 6/2007 | Hayakawa | 399/119 |
| 2007/0160386 | A1 * | 7/2007 | Kawamura | 399/110 |
| 2007/0160388 | A1 | 7/2007 | Yoshimura et al. | 399/111 |
| 2008/0138107 | A1 * | 6/2008 | Mori et al. | 399/111 |
| 2008/0159772 | A1 | 7/2008 | Koishi et al. | 399/90 |
| 2008/0159773 | A1 | 7/2008 | Murayama et al. | 399/90 |

FOREIGN PATENT DOCUMENTS

| | | | |
|---|---|---|---|
| EP | 1 705 532 | A1 | 9/2006 |
| EP | 1 762 913 | | 3/2007 |
| JP | 04-204553 | | 7/1992 |
| JP | 2003-167499 | A | 6/2003 |
| JP | 2004-61596 | | 2/2004 |
| JP | 2005-99517 | | 4/2005 |
| JP | 2005-242067 | | 9/2005 |
| JP | 2006-65267 | | 3/2006 |
| JP | 2006-259448 | | 9/2006 |
| JP | 2006-337413 | | 12/2006 |
| JP | 2007-213025 | | 8/2007 |
| JP | 2008-165023 | | 7/2008 |
| KR | 10-2006-0011782 | | 2/2006 |
| WO | WO 2007/081042 | A1 | 7/2007 |

OTHER PUBLICATIONS

Written Opinion in Singapore Patent Application No. 200907680-3, dated Feb. 11, 2011.

Office Action in Russian Patent Application No. 2010102894/28, dated Mar. 22, 2011 (with English translation).

Translation of Hungarian Search Report and Written Opinion dated May 13, 2010, in Application No. 2009076803.

International Search Report for PCT Application No. PCT/JP2007/050622 issued May 4, 2007.

Search and Examination Report in Singapore Patent Application No. 200907680-3, issued Feb. 7, 2012.

Office Action in Japanese Patent Application No. 0063042-01, dated Sep. 8, 2009 (with excerpt translation).

Office Action in Japanese Patent Application No. 0063042-01, dated Aug. 9, 2011 (with excerpt translation).

Notice of Allowance in Korean Patent Application No. 10-2010-700146 , dated Mar. 29, 2012.

Decision on Grant in Russian Patent Application No. 2010102894/28, dated Feb. 22, 2012 (with translation).

Notice of Acceptance in Australian Patent Application No. 2008272030 dated Mar. 14, 2012.

English translation of Japanese Laid-open Patent Application Pub. No. 2004-61596, Pub Date Feb. 26, 2004.

Office Action in Korean Patent Application No. 10-2011-7024577, mailed Nov. 30, 2012.

* cited by examiner (a)

(b)

PROCESS CARTRIDGE AND ELECTROPHOTOGRAPHIC IMAGE FORMING APPARATUS

FIELD OF THE INVENTION AND RELATED ART

The present invention relates to a process cartridge made up of an electrophotographic photosensitive drum and a development roller (which processes photosensitive drum), in particular, a process cartridge, the electrophotographic photosensitive drum and development roller of which can be placed in contact with, or separated from, each other. The present invention also relates to an electrophotographic image forming apparatus employing the above described process cartridge.

In recent years, a process cartridge system has come to be widely used in the field of an image forming apparatus which uses an electrophotographic image forming process. A process cartridge system is one of the electrophotographic image forming systems. It uses a cartridge in which an electrophotographic photosensitive drum, and a development roller, that is, a roller for processing an electrophotographic photosensitive drum, are integrally disposed to make them removably mountable in the main assembly of an image forming apparatus. Thus, the employment of a process cartridge system makes it possible for a user to maintain an electrophotographic image forming apparatus without relying on a service person. This is why a process cartridge system has come to be widely used in the field of an electrophotographic image forming apparatus.

A process cartridge is structured so that its development roller is kept pressured toward its electrophotographic photosensitive drum with the application of a preset amount of pressure, in order to keep the development roller in contact with the photosensitive drum when forming an image. In a case of a so-called contact development method, that is, a development method which places a development roller in contact with a photosensitive drum to develop a latent image on the photosensitive drum, the elastic layer of the development roller is kept pressed upon the peripheral surface of the photosensitive drum so that a preset amount of contact pressure is maintained between the peripheral surface of the development roller and that of the photosensitive drum.

Therefore, if a process cartridge is left unused in the main assembly of an image forming apparatus for a substantial length of time, the elastic layer of the development roller sometimes deforms. Thus, if an image forming apparatus in which a process cartridge has been left unused for a substantial length of time is used for the first time thereafter, it is possible that a latent image will be nonuniformly developed. Further, in the case of a so-called contact development method, a development roller is in contact with a photosensitive drum during development. Therefore, developer sometimes transfers from a development roller onto the points of the peripheral surface of a photosensitive drum, to which developer is not to supposed to adhere. Further, not only do a photosensitive drum and a development roller rotate in contact with each other during development, but also, during processes other than development. Therefore, a so-called contact development method exacerbates the deterioration of a photosensitive drum, a development roller, and developer.

One of the solutions to the above described problem is proposed in Japanese Laid-open Patent Application 2003-167499. According to this patent application, an image forming apparatus is provided with a mechanism which acts on a process cartridge to keep an electrophotographic photosensitive drum and a development roller separated from each other when an image is not actually being formed (Patent Document 1).

In the case of the image forming apparatus proposed in Patent Document 1, its main assembly is structured so that four process cartridges are removably mountable in the main assembly. Each cartridge is made up of a photosensitive member unit and a development unit. The photosensitive member unit has a photosensitive member. The development unit supports a development roller, and is connected to the photosensitive member unit so that it can be rotationally moved relative to the photosensitive member unit. Further, the main assembly of the image forming apparatus is provided with a separation plate, whereas the process cartridge is provided with a force receiving portion. As the separation plate is moved, the force receiving portion receives the force from the separation plate, causing the development unit to move relative to the photosensitive member unit. As a result, the development roller, which was in contact with the photosensitive drum, separates from the photosensitive drum.

According to the prior art, the force receiving portion, that is, the portion which catches the force for separating a development roller and a photosensitive member from each other, remains projecting beyond the external contour of the development unit. Therefore, it is liable to be damaged while a user handles a process cartridge, or a process cartridge is conveyed alone. Further, the presence of the above described force receiving portion has been one of the major problems which arose when studies were made to reduce in size a process cartridge structured so that its electrophotographic photosensitive member and development roller can be placed in contact with, or separated from, each other, and also, when studies were made to reduce in size the main assembly of an image forming apparatus in which such a process cartridge as the one described above is removably mountable.

SUMMARY OF THE INVENTION

The primary object of the present invention is to provide a process cartridge, the electrophotographic photosensitive drum and development roller of which can be placed in contact with, or separated from, each other, and which is significantly smaller in size than a counterpart in accordance with the prior art, and also, to provide an electrophotographic image forming apparatus in which a process cartridge in accordance with the present invention, is removably mountable.

Another object of the present invention is to provide a process cartridge, the force receiving portion of which is significantly less liable to be damaged while the process cartridge is transported alone, than a counterpart in accordance with the prior art.

According to an aspect of the present invention, there is provided a process cartridge detachably mountable to a main assembly of an electrophotographic image forming apparatus, comprising an electrophotographic photosensitive drum; developing roller for developing an electrostatic latent image formed on said electrophotographic photosensitive drum; drum frame supporting said electrophotographic photosensitive drum; a developing frame supporting said developing roller, said developing roller being movable relative to said drum frame between a contacting position in which said developing roller is in contact with said electrophotographic photosensitive drum and a spacing position in which said developing roller is spaced from said electrophotographic photosensitive drum; a force receiving member, provided movably relative to said developing frame, for receiving an external force, wherein said force receiving member is capable of taking an operating position for moving said developing frame from the contacting position to the spacing position by receiving the external force, and a stand-by position retracted from the operating position; an urging portion for urging said force receiving member from the stand-by position toward the operating position; and an engaging portion for engaging with said force receiving member to hold said force receiving member in the stand-by position against an urging force of said urging portion.

According to another aspect of the present invention, there is provided an electrophotographic image forming apparatus for forming an image on a recording material, said apparatus comprising:

(i) a movable force applying member;

(iii) mounting means;

(iii) a process cartridge detachably mounted to said mounting means, said process cartridge including an electrophotographic photosensitive drum, developing roller for developing an electrostatic latent image formed on said electrophotographic photosensitive drum, drum frame supporting said electrophotographic photosensitive drum, a developing frame supporting said developing roller, said developing roller being movable relative to said drum frame between a contacting position in which said developing roller is in contact with said electrophotographic photosensitive drum and a spacing position in which said developing roller is spaced from said electrophotographic photosensitive drum, a force receiving member, provided movably relative to said developing frame, for receiving an external force when the force applying member moves, wherein said force receiving member is capable of taking an operating position for moving said developing frame from the contacting position to the spacing position by receiving the external force, and a stand-by position retracted from the operating position, an urging portion for urging said force receiving member from the stand-by position toward the operating position, and an engaging portion for engaging with said force receiving member to hold said force receiving member in the stand-by position against an urging force of said urging portion, and (vi) feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Next, referring to FIGS. 1-4, the process cartridges and electrophotographic image forming apparatuses in this preferred embodiment of the present invention will be described.

Figure 1:
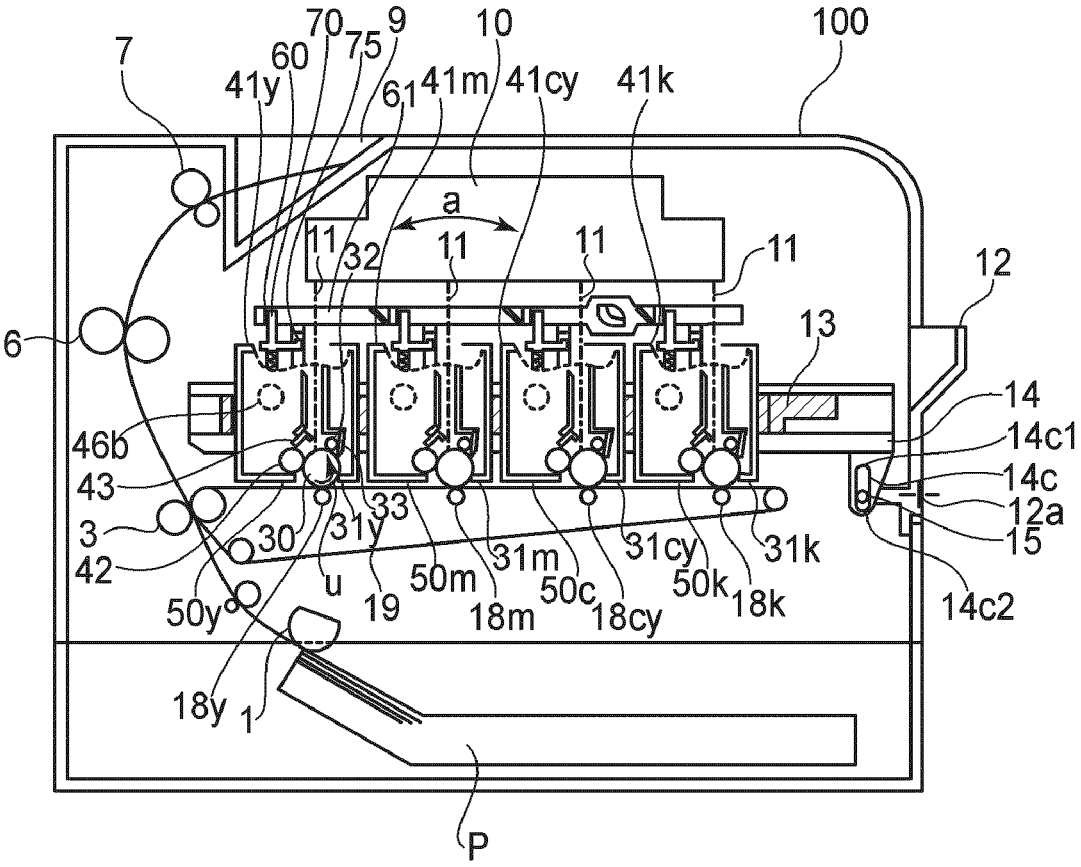
FIG. 1 is a schematic sectional view of the electrophotographic image forming apparatus in the first embodiment of the present invention, showing the general structure of the apparatus.
Figure 2:
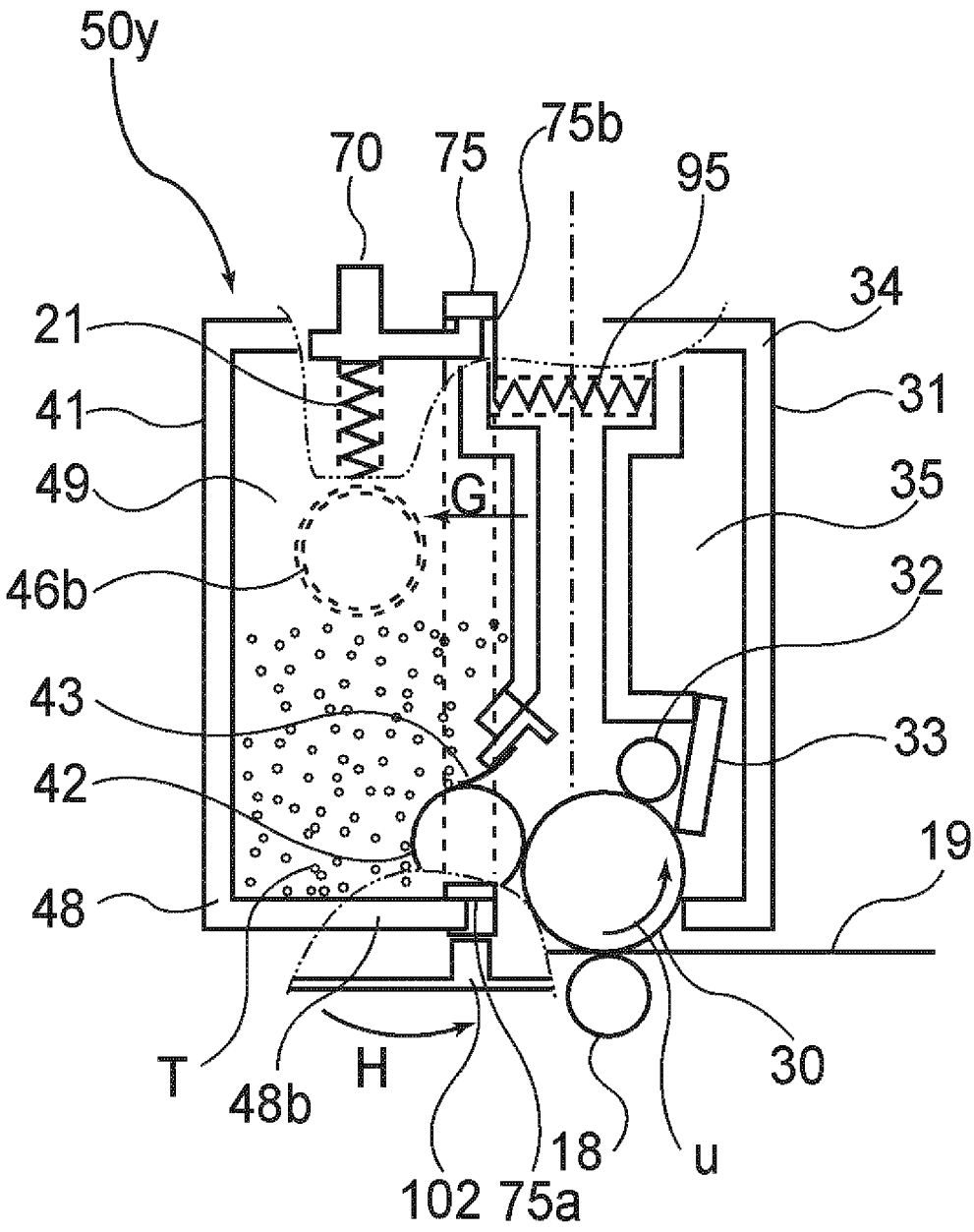
FIG. 2 is a schematic sectional view of the process cartridge in the first embodiment of the present invention.
Figure 3:
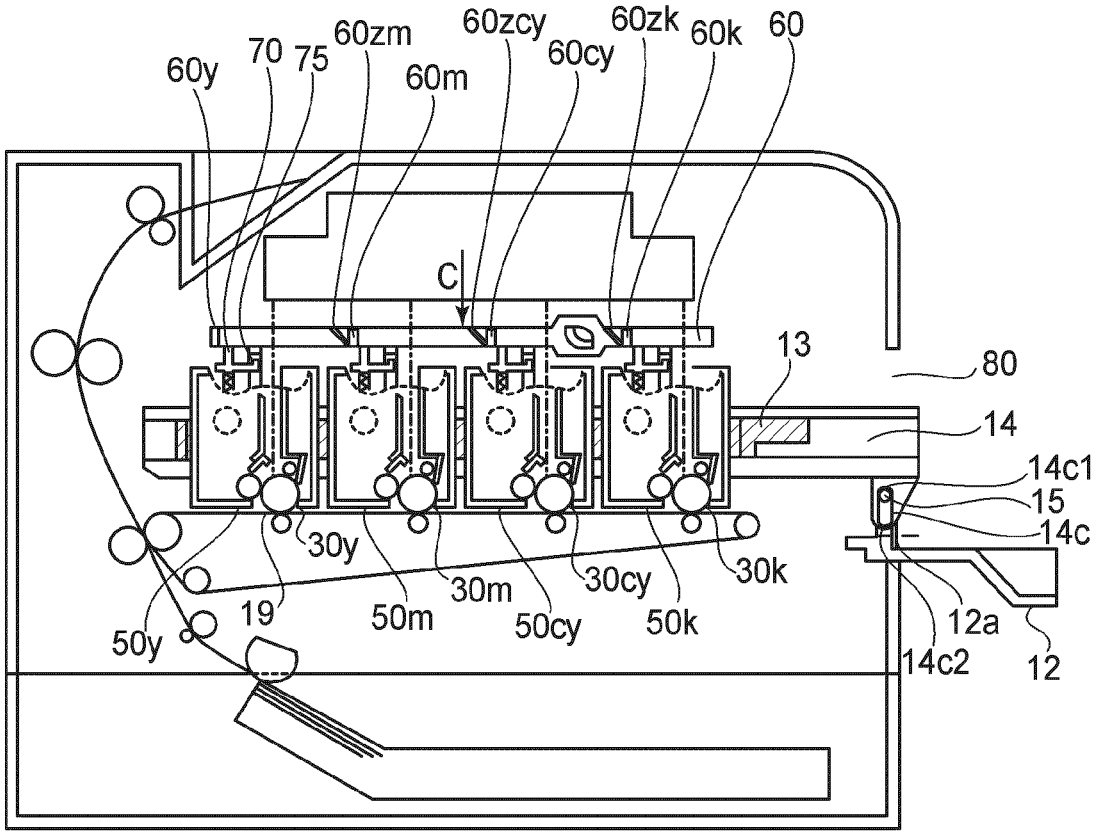
FIG. 3 is also a schematic sectional view of the electrophotographic image forming apparatus in the first embodiment of the present invention, showing the general structure of the apparatus.
Figure 4:
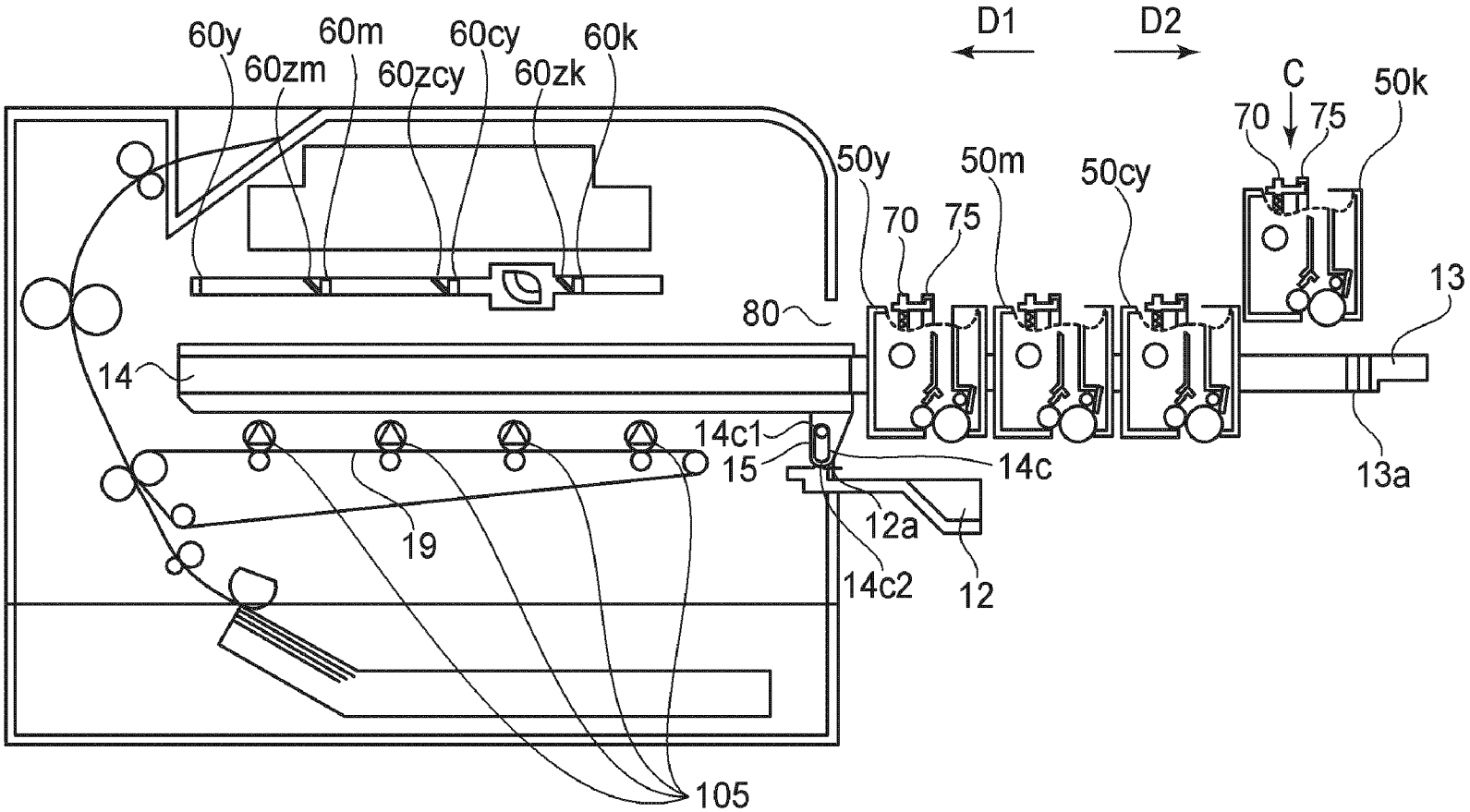
FIG. 4 is another schematic sectional view of the electrophotographic image forming apparatus in the first embodiment of the present invention, showing how the process cartridges therein are replaced.

FIG. 1 is a schematic sectional view of the electrophotographic image forming apparatus 100 (which hereafter will be referred to simply as apparatus main assembly), in which multiple (four) process cartridges 50*y*, 50*m*, 50*c*, and 50*k* (which hereafter may be referred to simply as cartridges 50) which have been removably mounted. The multiple (four) cartridges 50 store yellow, magenta, cyan, and black toners (developers), one for one. FIG. 2 is a schematic sectional view of the cartridge itself. FIGS. 3 and 4 are schematic sectional drawings of the electrophotographic image forming apparatus in this embodiment, which are for showing how any cartridge or cartridges 50 are removed from the main assembly of the image forming apparatus.

{General Structure of Electrophotographic Image Forming Apparatus}

The electrophotographic image forming apparatus in this embodiment is structured to carry out the following image forming operation. Referring to FIG. 1, first, the uniformly charged area of the peripheral surface of each of the electrophotographic photosensitive drums (which hereafter will be referred to as photosensitive drums) 30*y*, 30*m*, 30*c*, and 30*k* is scanned by a beam of laser light 11 projected by a laser scanner 10, with which the apparatus main assembly 100 is provided, while being modulated with pictorial signals. As a result, an electrostatic latent image is effected on the peripheral surface of each photosensitive drum 30. This electrostatic latent image is developed by a development roller 42, into a visible image; an image is formed of toner (developer) on the peripheral surface of the photosensitive drum 30. In other words, yellow, magenta, cyan, and black toner images are formed on the photosensitive drums 30*y*, 30*m*, 30*c*, and 30*k*, respectively. Then, these toner images are sequentially transferred by the voltages applied to transfer rollers 18*y*, 18*m*, 18*c*, and 18*k*, onto a transfer belt 19 supported and stretched by rollers 20-22. Thereafter, the toner images on the transfer belt 19 are transferred by a transfer roller 3, onto a sheet of recording medium P delivered by a recording medium conveyance roller 1 as a recording medium conveying means. Then, the recording medium P is conveyed to a fixation unit 6 made up of a driver roller, and a fixation roller having an internal heater. In the fixation unit 6, heat and pressure is applied to the recording medium P and the toner images thereon. As a result, the toner images on the recording medium P are fixed to the recording medium P. Then, the recording medium P is discharged onto a delivery tray 9 by a pair of discharge rollers 7.

{General Structure of Process Cartridge}

Next, referring to FIGS. 1, 2, 5-8, 29 and 30, the cartridges 50 (50*y*, 50*m*, 50*c*, and 50*k*) in this embodiment will be described. The multiple (four) cartridges 50 in this embodiment are the same in structure although they are different in the color of the toner T they store. Thus, the structure of the cartridges 50 will be described with reference to the cartridge 50*y*.

Referring to FIG. 2, the cartridge 50*y* is provided with a photosensitive drum 30, and processing means which process the photosensitive drum 30. The processing means in this embodiment are a charge roller 32 which is the charging means for charging the photosensitive drum 30, a development roller 42 which is the developing means for developing a latent image formed on the photosensitive drum 30, a blade 33 which is the cleaning means for removing the residual toner remaining on the peripheral surface of the photosensitive drum 30, etc. The cartridge 50*y* is made up of a drum unit 31 and a development unit 41.

{Structure of Drum Unit}

Figure 9:
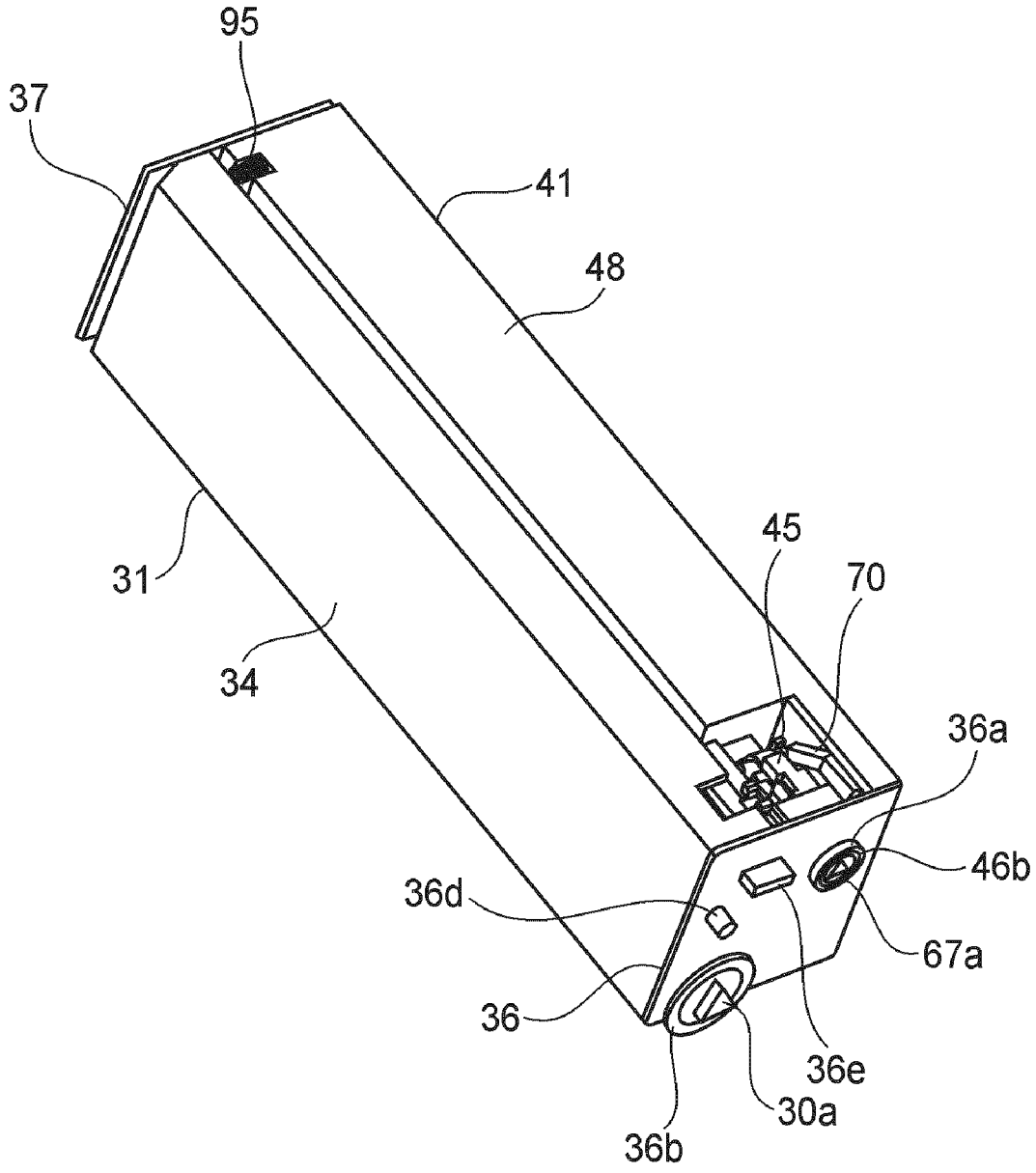
FIG. 9 is a perspective view of the process cartridge in the first embodiment of the present invention, as seen from the side from which the cartridge is driven.
Figure 10:
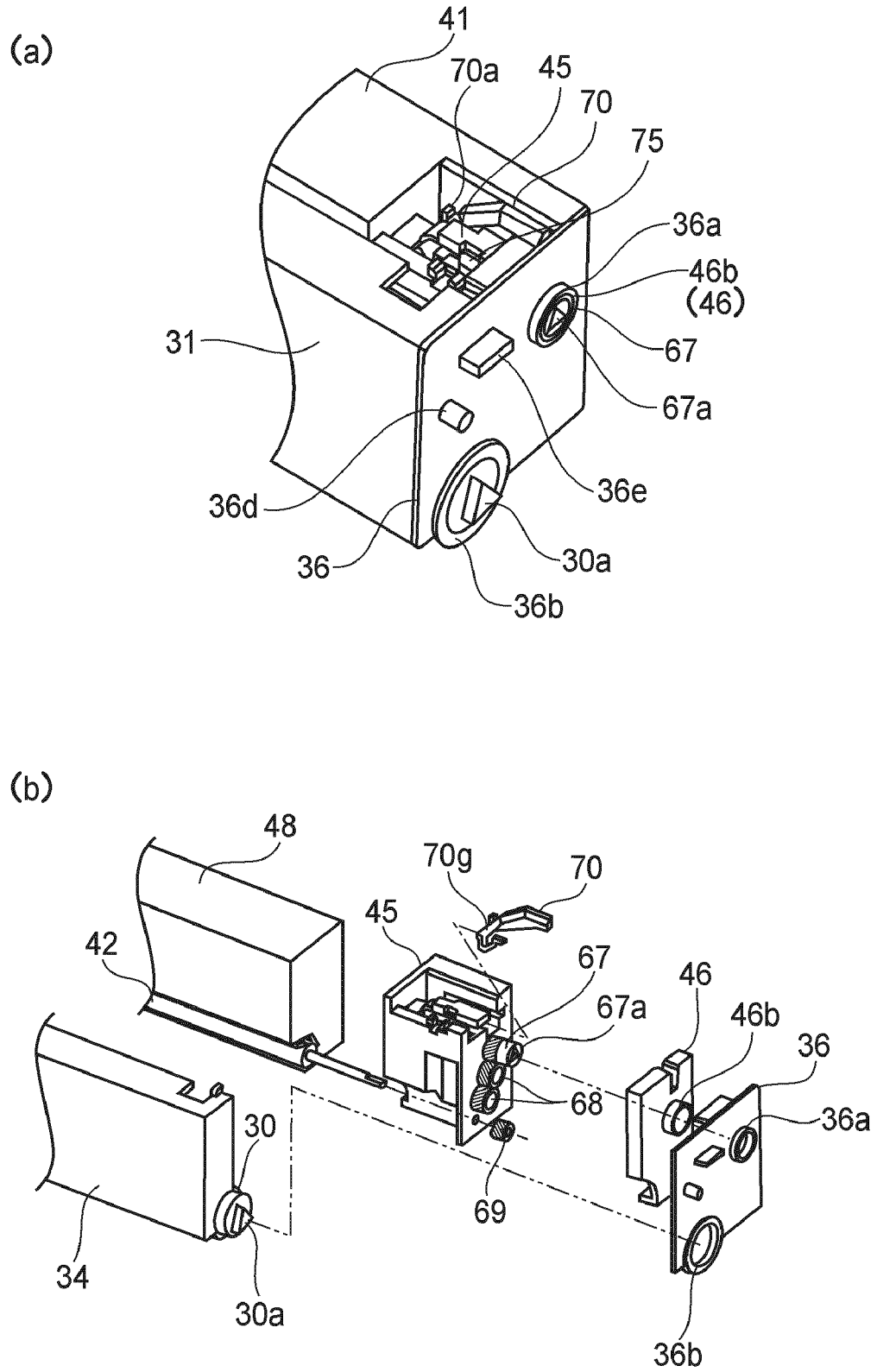
FIGS. 10 (*a*) and 10 (*b*) are a perspective view of the process cartridge in the first embodiment of the present invention, as seen from the side from which the cartridge is driven.
Figure 11:
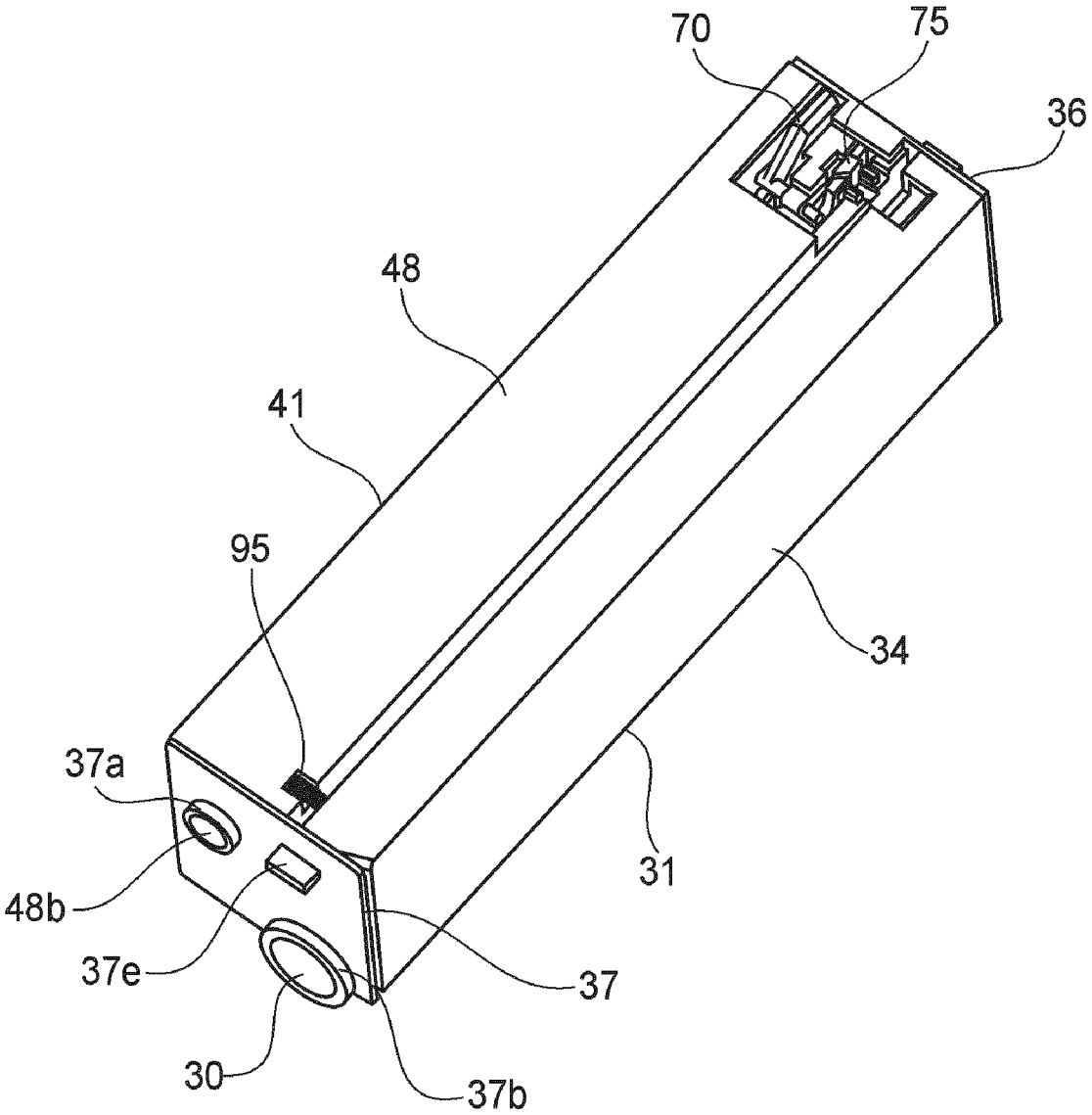
FIG. 11 is a perspective view of the process cartridge in the first embodiment of the present invention, as seen from the opposite side from the side from which the cartridge is driven.
Figure 12:
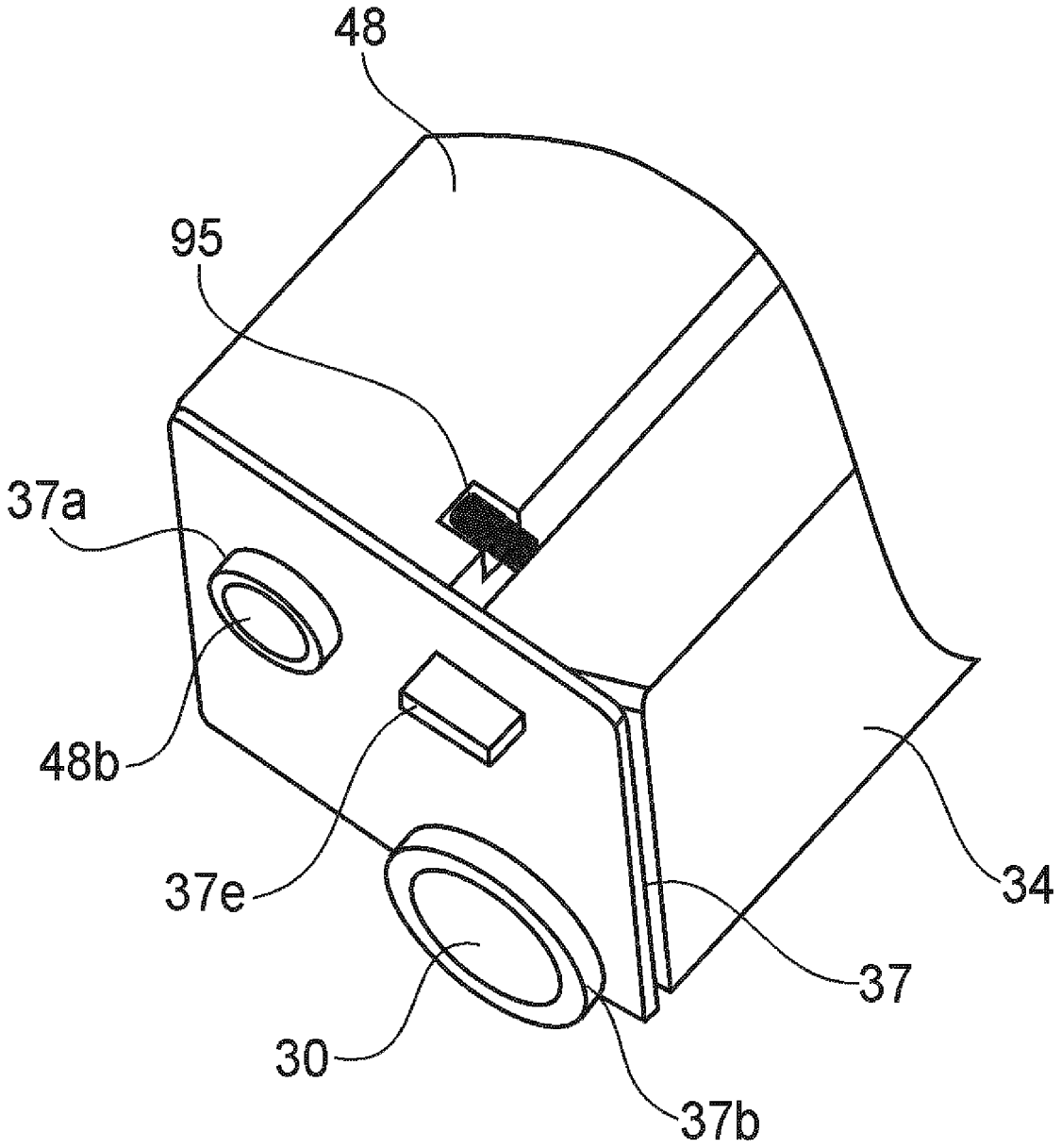
FIG. 12 is a perspective view of the process cartridge in the first embodiment of the present invention, as seen from the opposite side from the side from which the cartridge is driven.

Referring to FIGS. 2, 4, 9-12, and 30, the drum unit 31 includes the abovementioned photosensitive drum 30, charge roller 32, and blade 33. It also includes a waste toner storing portion 35, a drum unit main frame 34, and lateral covers 36 and 37 (which hereafter will be referred to simply as cover). Referring to FIGS. 9, 10(*a*) and 10(*b*), one of the lengthwise end portions of the photosensitive drum 30 is rotatably supported by the supporting portion 36*b* of the cover 36, whereas the other lengthwise end of the photosensitive drum 30 is rotatably supported by the supporting portion 37*b* of the cover 37 as shown in FIGS. 11 and 12. The covers 36 and 37 are firmly attached to the lengthwise ends of the drum unit main frame 34, one for one. Next, referring to FIGS. 9, 10(*a*), and 10(*b*), the lengthwise end portion of the photosensitive drum 30 is provided with a coupling member 30*a* for transmitting driving force to the photosensitive drum 30. The coupling member 30*a* engages with a first coupling member 105 of the apparatus main assembly 100, shown in FIGS. 4 and 30, as the cartridge 50*y* is mounted into the apparatus main assembly 100. Thus, as driving force is transmitted from a motor (unshown) with which the apparatus main assembly 100 is provided, to the coupling member 30*a*, the photosensitive drum 30 rotates in the direction indicated by an arrow mark u in FIG. 2. The charge roller 32 is supported by the drum unit main frame 34 so that it is rotated in contact with the photosensitive drum 30 by the rotation of the photosensitive drum 30. The blade 33 is supported also by the drum unit main frame 34 so that it remains in contact with the peripheral surface of the photosensitive drum 30 with the presence of a preset amount of pressure between the blade 33 and the peripheral surface of the photosensitive drum 30. The covers 36 and 37 are provided with holes 36*a* and 37*a* for supporting the development unit 42 in such a manner that the development unit 42 is rotationally movable relative to the drum unit 31.

{Structure of Development Unit}

Figure 30:
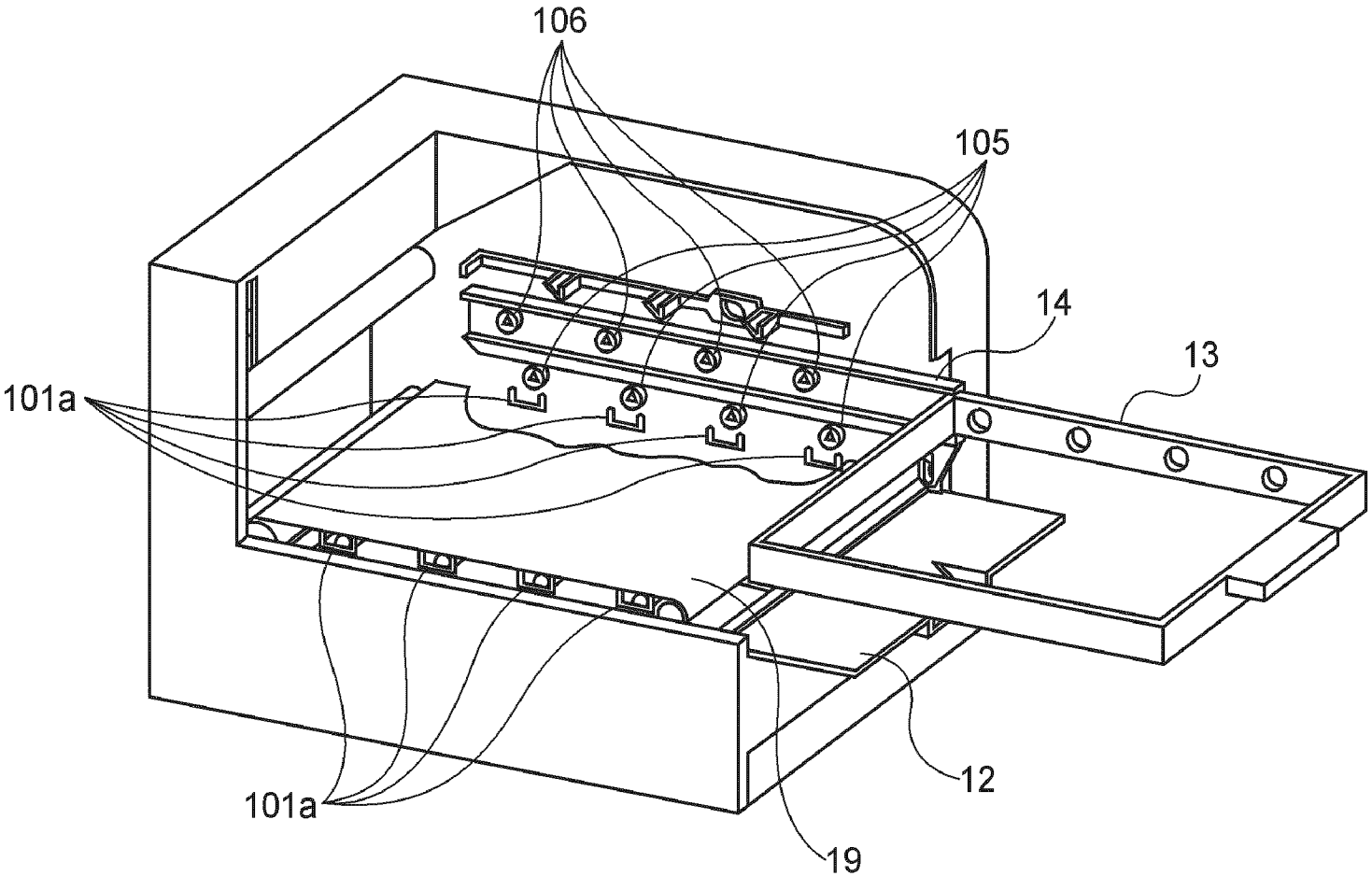
FIG. 30 is a partially cutaway perspective view of the electrophotographic image forming apparatus in the first embodiment of the present invention.

Referring to FIGS. 2, 10(*a*), and 10(*b*), the development unit 41 has the abovementioned development roller 42. It also has a development blade 43, a development unit main frame 48, a bearing unit 45, and a pair of lateral covers 46. The development unit main frame 48 has a toner storage portion 49 in which the toner to be supplied to the development roller 42 is stored. It supports the development blade 34 which regulates the thickness to which toner is coated on the peripheral surface of the development roller 42. Referring to FIGS. 10(*a*) and 10(*b*), the bearing unit 45 is firmly attached to one of the lengthwise end portions of the development unit main frame 48. It rotatably supports the development roller 42, one of the lengthwise end portions of which has a development roller gear 69. Further, the bearing unit 45 is provided with an idler gear 68, which transmits driving force from a coupling member 67 to the development roller gear 69. The cover 46 is securely attached to the outward side of the bearing unit 45, in terms of the lengthwise direction of the bearing unit 45, in a manner to cover the coupling member 67 and idler gear 68. Further, the cover 46 is provided with a cylindrical portion 46*b*, which protrudes outward from the outward surface of the cover 46. The coupling member 67 is exposed through the hollow of the cylindrical portion 46*b*. The apparatus main assembly 100 and process cartridge 50*y* are structured so that as the process cartridge 50*y* is mounted into the apparatus main assembly 100, the coupling portion 67*a* of the coupling member 67 engages with the second coupling member 106 of the apparatus main assembly 100, which is shown in FIG. 30, transmitting thereby driving force from the motor (unshown) with which the apparatus main assembly 100 is provided, to the process cartridge 50*y*.

{Connection of Development Unit to Drum Unit}

Referring to FIGS. 10(*a*) and 10(*b*), the development unit 41 and drum unit 31 are connected in the following manner: First, at one end of the process cartridge 50*y*, the cylindrical portion 46*b* is fitted into the supporting hole 36*a*. At the other end, a projection 48*b* which projects from the development unit main frame 48 is fitted into the supporting hole 37*a*. As a result, the development unit 41 is connected to the drum unit 31 in such a manner that the development unit 41 is rotationally movable relative to the drum unit 31. Next, referring to FIGS. 9 and 11, the development unit 41 is kept pressured by a compression spring 95, which are elastic members, in the direction to be rotated about the cylindrical portion 46*b* and projection 48*b* so that the development roller 42 is kept in contact with the photosensitive drum 30. That is, the development unit 41 is kept pressed by the resiliency of the compression spring 95 in the direction indicated by a narrow mark G, generating a moment H which acts in the direction to rotate the development unit 41 about the cylindrical portion 46*b* and projection 48*b*. Thus, the development roller 42 is kept in contact with the photosensitive drum 30 with the presence of the preset amount of contact pressure between the development roller 42 and photosensitive drum 30. The position in which the development unit 41 is when it is kept in contact with the photosensitive drum 30 is referred to as "contact position".

Referring to FIGS. 9 and 11, the compression spring 95 in this embodiment is located on the opposite side from one of the lengthwise end portions, where the coupling member 30*a* of the photosensitive drum 30, and the coupling member 67 of the development roller 42, are located. This is for the following reason: As the coupling member 67 of the development roller 42 receives driving force from the coupling member 106 of the apparatus main assembly 100, the moment H is generated in the direction to rotate the development unit 41 about the cylindrical portion 46*b*, as shown in FIG. 2. Thus, at the lengthwise end of the cartridge 50*y*, the development roller 42 is pressed upon the photosensitive drum 30, generating thereby the preset amount of contact pressure between the development roller 42 and photosensitive drum 30, whereas, at the other lengthwise end, the development roller 42 is kept pressed upon the photosensitive drum 30 by the compression spring 95.

{Force Receiving Member}

Figure 13:
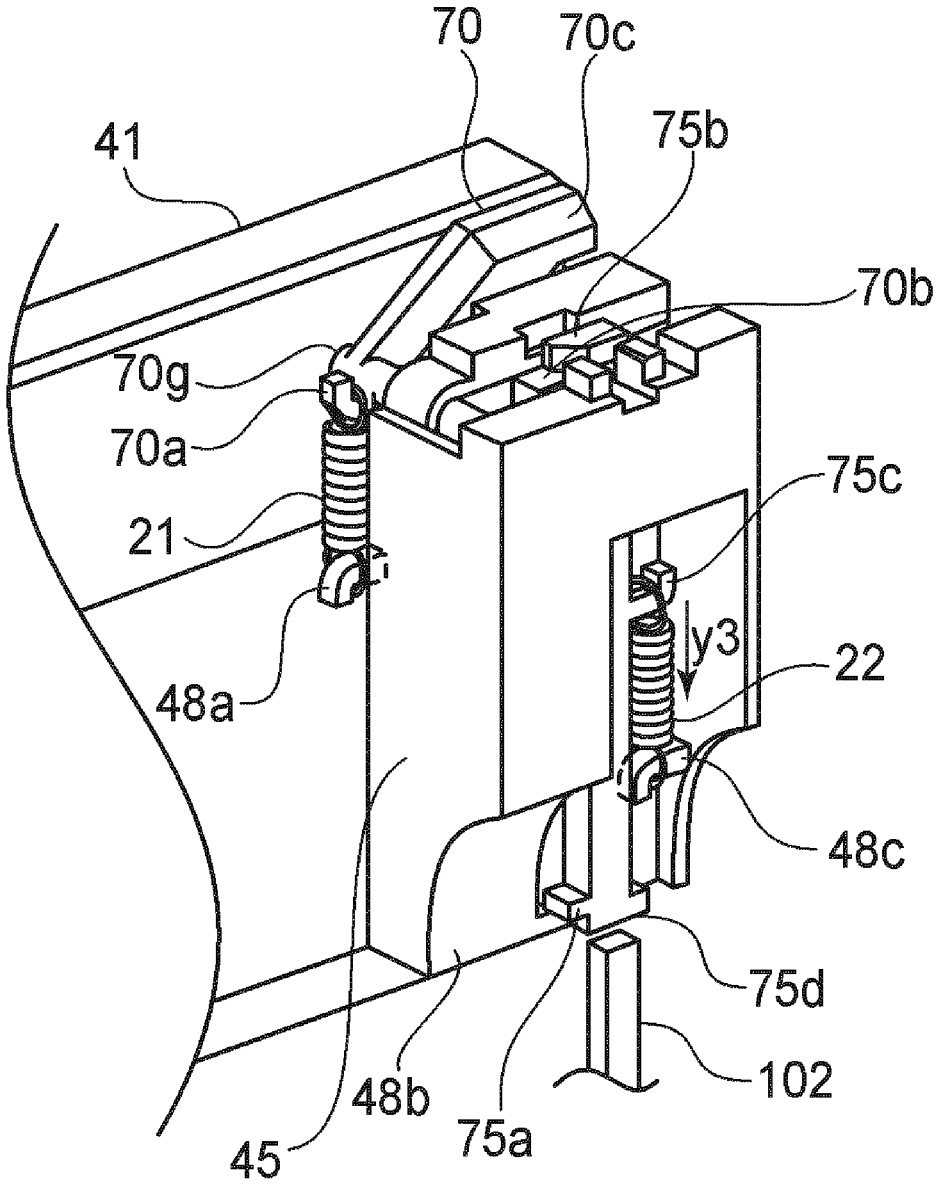
FIG. 13 is a perspective view of the force receiving member and releasing member in the first embodiment of the present invention, showing in detail the mechanical structure thereof.
Figure 14:
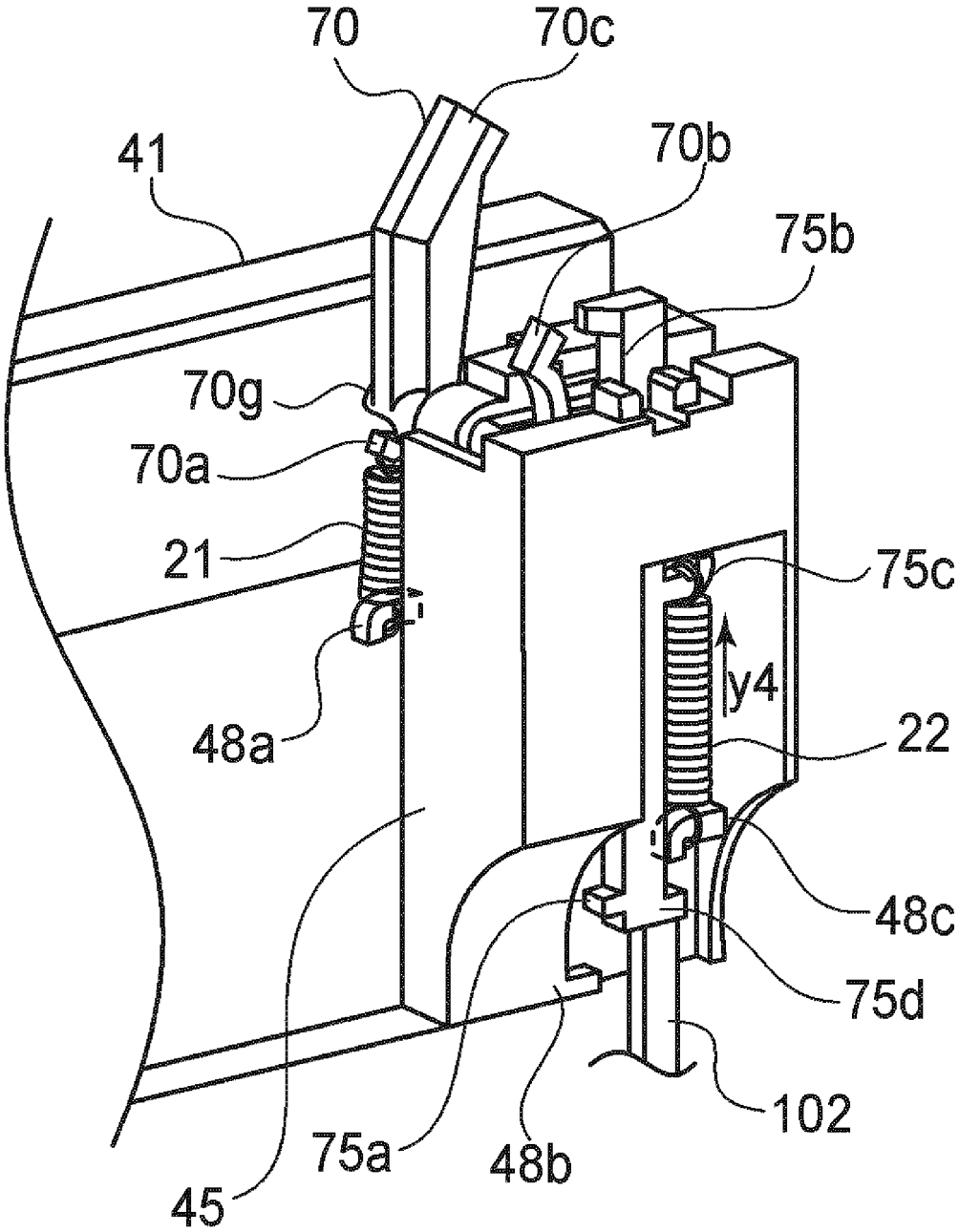
FIG. 14 is another perspective view of the force receiving member and releasing member in the first embodiment of the present invention, showing in detail the mechanical structure thereof.

Referring to FIGS. 5-8, the cartridge 50*y* is provided with a force receiving member 70 for placing the development roller 42 and photosensitive drum 30 in contact with each other, or separating them from each other, in the apparatus main assembly 100. Next, referring to FIGS. 10(*a*), 10(*b*), 13, and 14, the force receiving member 70 has a hook portion 70*a*. The hook portion 70*a* is connected to one end of a spring 21 for keeping the force receiving member 70 pressured, whereas the other end of the spring 21 is connected to the hook portion 48*a* of the development unit frame 48, as shown in FIGS. 13 and 14.

Referring to FIG. 10(*b*), the force receiving member 70 is attached to a bearing unit 45 by engaging a rotational shaft 70*g*, which is a part of the force receiving member 70, with the guiding portion of the bearing unit 45. After the attachment of the force receiving member 70, the cover 46 is attached to the development unit frame 45 in a manner to cover the bearing unit 45 from the direction parallel to the axial line of the development roller 42. The detail of the operation of the force receiving member 70 will be given later.

{Cartridge Tray of Electrophotographic Image Forming Apparatus Main Assembly}

Next, the cartridge tray 13, which is in the form of a drawer, will be described.

Figure 5:
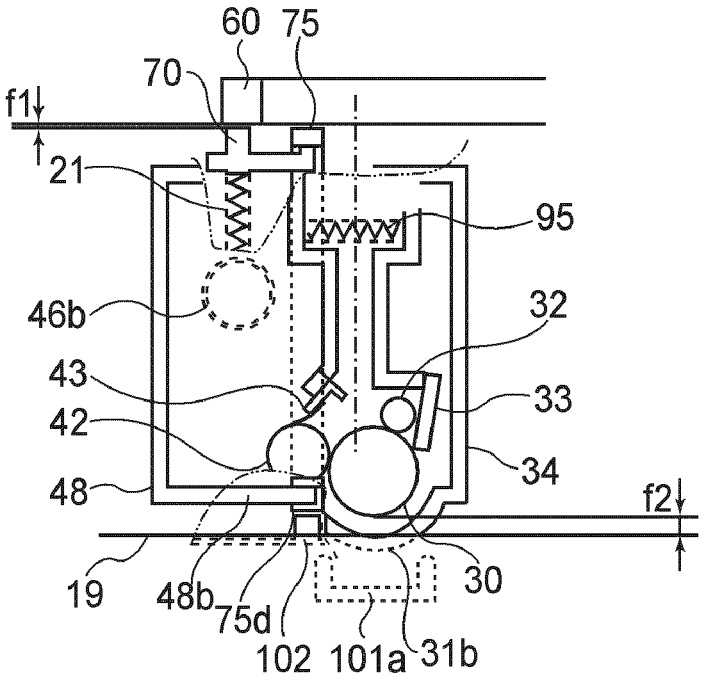
FIG. 5 is a schematic sectional view of one of the process cartridges, and its adjacencies, in the electrophotographic image forming apparatus in the first embodiment of the present invention, at a plane perpendicular to the axial line of the photosensitive drum.

Referring to FIG. 4, the cartridge tray 13 is attached to the apparatus main assembly 100 in such a manner that, in practical terms, it can be horizontally and linearly moved relative to the apparatus main assembly 100. That is, the cartridge tray 13 can be moved (pushed into, or pulled out of, the apparatus main assembly 100) in the direction indicated by an arrow mark D1 or D2, respectively, which is virtually horizontal direction. The apparatus main assembly 100 is structured so that the cartridge tray 13 can be locked in the innermost position (image forming position, shown in FIG. 1, in the apparatus main assembly 100), and the outermost position (cartridge replacement position: cartridge mounting or removing position, shown in FIG. 4, which is the farthest position to which the cartridge tray 13 can be pulled out). The cartridge 50 is mounted into the cartridge tray 13 by an operator in the direction indicated by an arrow mark C, which is virtually parallel to the direction of gravity, as shown in FIG. 4. The cartridge tray 13 is structured so that as the cartridges 50 are mounted into the cartridge tray 13, the cartridges 50 become arranged in tandem, in the direction parallel to the direction in which the cartridge tray 13 is movable, with their lengthwise direction (which is parallel to axial lines of photosensitive drum 30 and development roller 42) being perpendicular to the moving direction of the cartridge tray 13. As the cartridge tray 13 is pushed into the apparatus main assembly 100, the cartridges 50 in the cartridge tray 13 enter the apparatus main assembly 100, with the presence of a preset amount of gap f2 (FIG. 5) between the photosensitive drum 30 in each cartridge 50, and an intermediary transfer belt 19 located below the cartridge path in the apparatus main assembly 100. Then, as the cartridge tray 13 is moved into its innermost position in the apparatus main assembly 100, each cartridge 50 is properly positioned in the apparatus main assembly 100 by the cartridge positioning portion 101*a* provided in the apparatus main assembly 100 (FIGS. 5 and 30). The cartridge positioning operation will be described later in detail. A user is to close the door 12 after pushing the cartridge tray 13 all the way into the apparatus main assembly 100. Closing the door 12 ensures that each cartridge 50 is properly mounted into the apparatus main assembly 100. Therefore, in terms of operability, this structural arrangement for the apparatus main assembly 100 and cartridges 50 is superior to the structural arrangement of an electrophotographic image forming apparatus in accordance with the prior art, which requires the cartridges 50 to be individually mounted into the apparatus main assembly 100 by a user.

Next, referring to FIGS. 23-26, the operation of the cartridge tray 13 will be described. FIGS. 23-26 do not show the cartridges 50, in order to make it easier to understand the operation of the cartridge tray 13.

Figure 23:
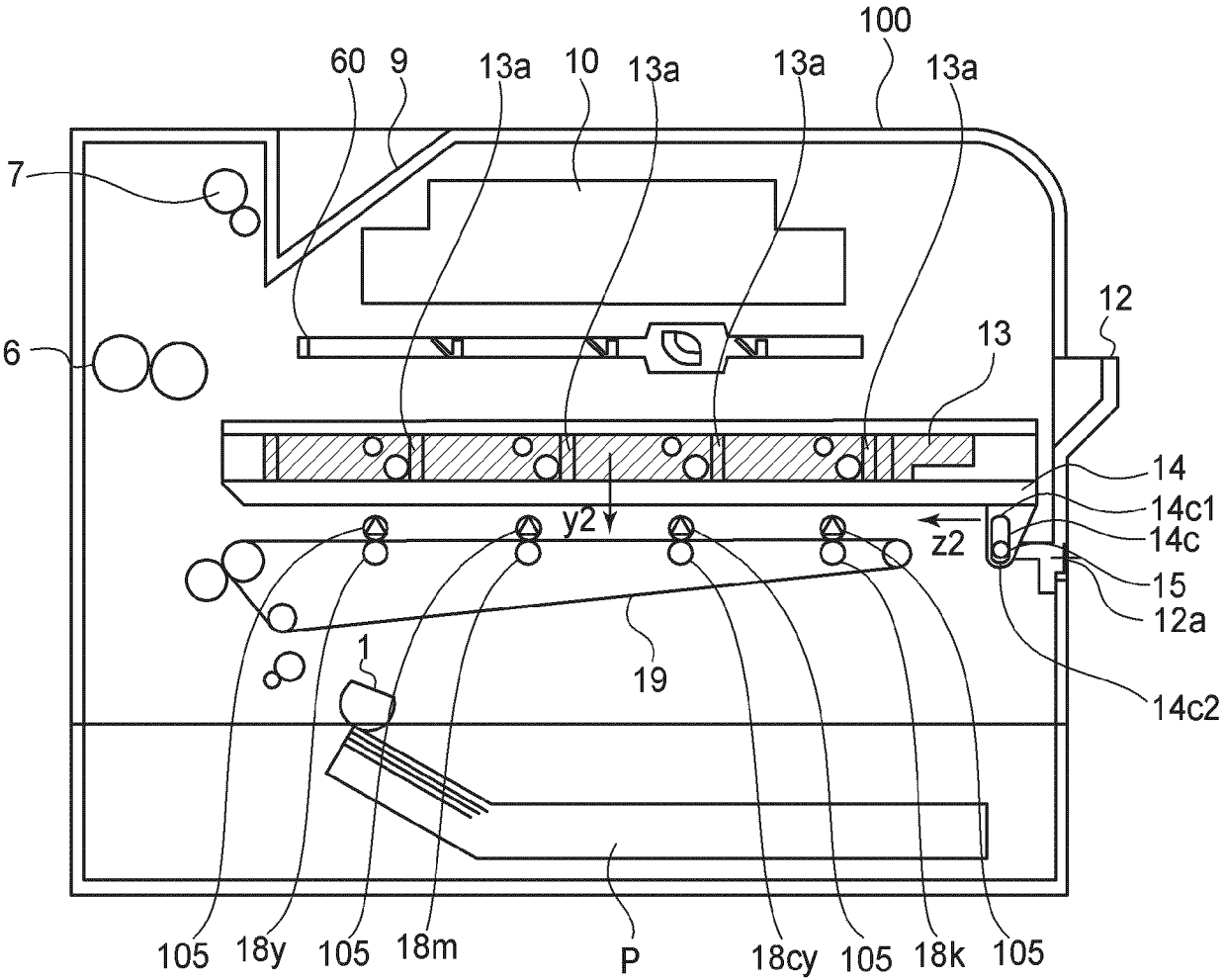
FIG. 23 is a schematic sectional view of the electrophotographic image forming apparatus in the first embodiment of the present invention, showing the general structure of the apparatus.
Figure 24:
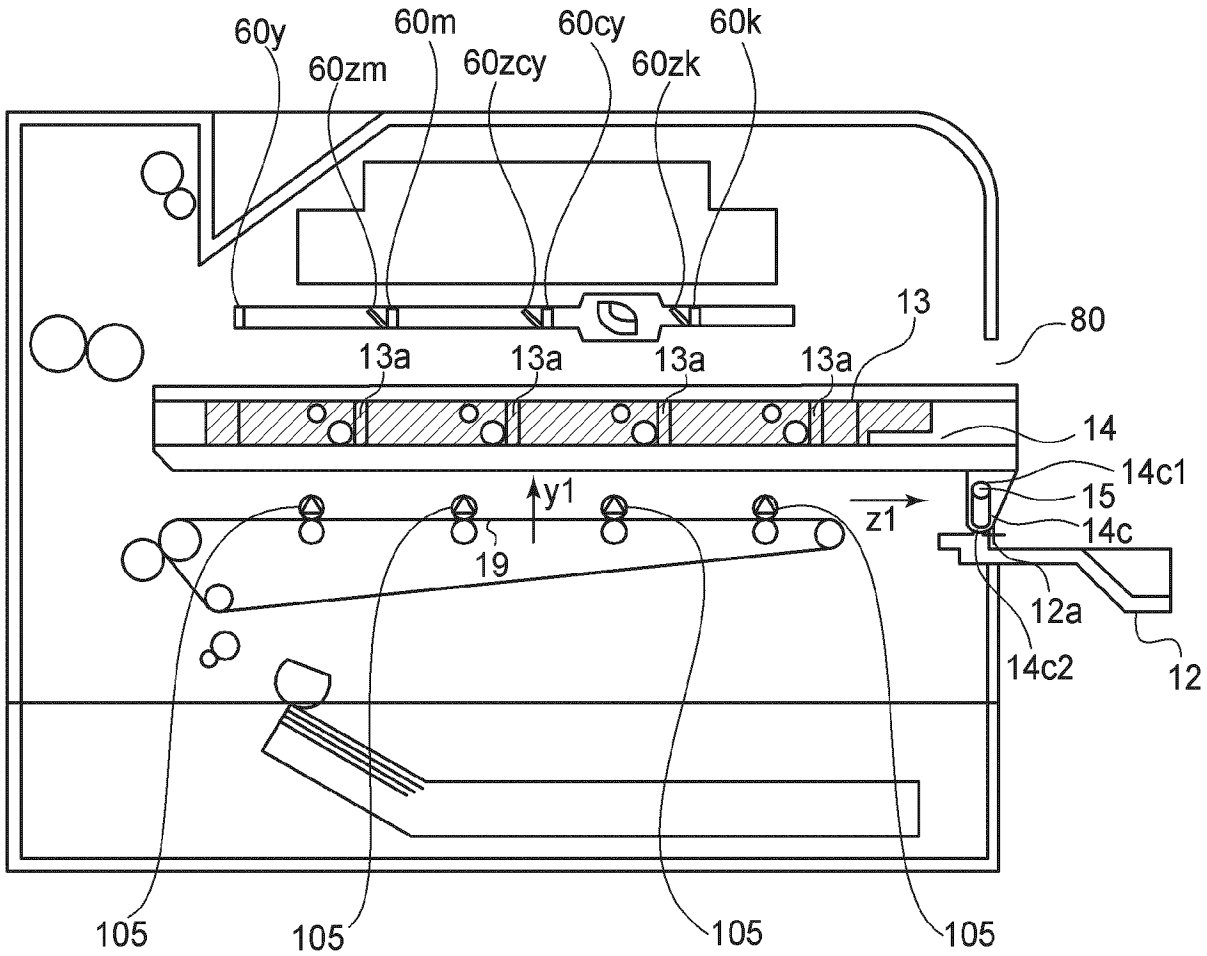
FIG. 24 is a schematic sectional view of the electrophotographic image forming apparatus in the first embodiment of the present invention, showing the general structure of the apparatus.

The cartridge tray 13 is supported by a pair of tray supporting members 14 in such a manner that the cartridge tray 13 can be pulled out of the apparatus main assembly 100 while remaining supported by the tray supporting members 14. The tray supporting members 14 are moved by the movement of the door 12 which can be opened or closed by an operator (user). The door 12 is attached to the apparatus main assembly 100 so that it can be rotationally moved about its rotational axis 12*a*. The door 12 is rotationally movable between a position (shut position) in which it completely covers an opening 80, as shown in FIG. 23, and a position (open position) in which it fully exposes the opening 80 as shown in FIG. 24.

Figure 25:
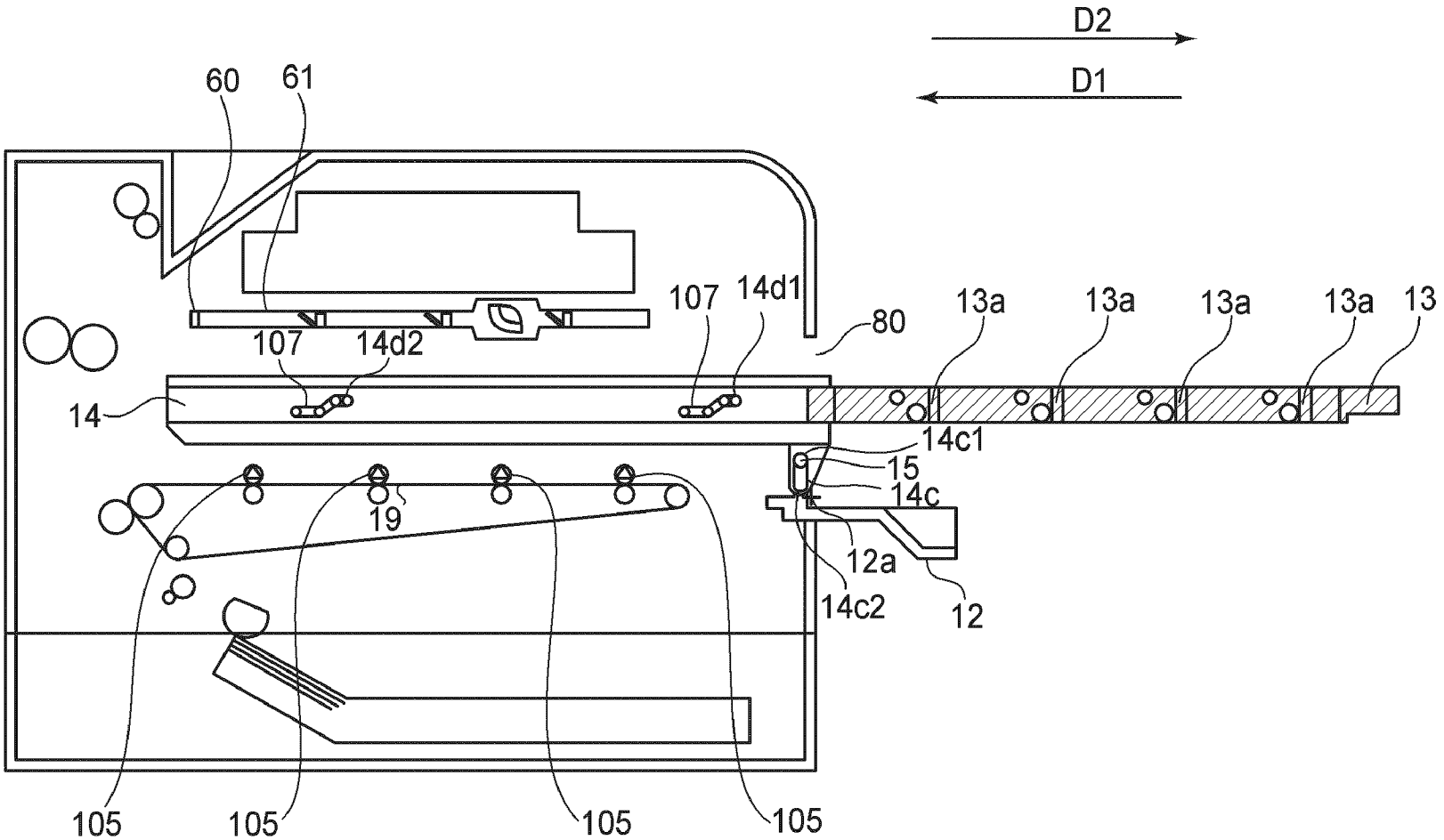
FIG. 25 is a schematic sectional view of the electrophotographic image forming apparatus in the first embodiment of the present invention, showing the general structure of the apparatus.
Figure 26:
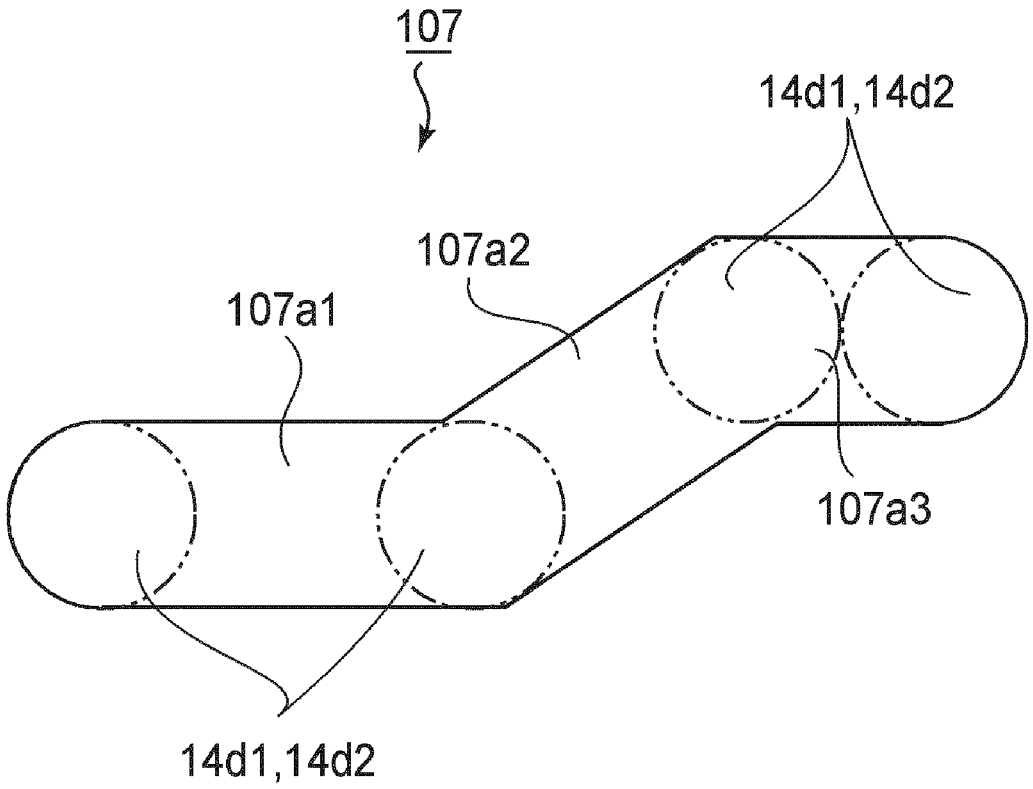
FIG. 26 is a schematic drawing of the guiding hole of the electrophotographic image forming apparatus in the first and second embodiments of the present invention.

When it is necessary to take out any cartridge 50 or cartridges 50 in the apparatus main assembly 100, the door 12 is to be rotationally moved from the shut position to the open position. As the door 12 is rotationally moved, a pair of projections 15 (connective pins) with which the door 12 is provided, move in the clockwise direction about the rotational axis 12*a*, while moving in a pair of elongated holes 14*c*, one for one, with which the tray supporting member 14 is provided, from the bottom end 14*c*2 of the elongated hole 14*c* to the top end 14*c*1 of the elongated hole 14*c*, as shown in FIG. 24. As a result, the tray supporting members 14 are moved by the projections 15 in the direction indicated by the arrow mark z1. As the tray supporting members 14 are moved in the abovementioned direction z1, the projections 14*d*1 and 14*d*2, which project from each of the tray supporting members 14 are guided by the guiding holes 107 with which the apparatus main assembly 100 is provided, as shown in FIG. 25. Referring to FIG. 26, each guiding hole 107 has three sections, that is, two horizontal sections 107*a*1 and 107*a*3, and one diagonal section 107*a*2. The diagonal section 107*a*2 extends diagonally upward from the horizontal section 107*a*1 to the horizontal section 17*a*3. Therefore, as the door 12 is moved from the shut position to the open position, as shown in FIG. 24, the projections 14*d*1 and 14*d*2 are guided by the guiding hole 107, sequentially through the horizontal section 107*a*1, diagonal section 107*a*2, and horizontal section 107*a*3. Thus, the tray supporting members 14 are first moved in the direction indicated by the arrow mark z1 (FIG. 24), and then, are moved in the direction indicated by an arrow mark y1 (FIG. 24), that is, direction to move away from the transfer belt 19. With the tray supporting members 14 moved all the way in the direction indicated by the arrow mark y1, the cartridge tray 13 can be pulled out of the apparatus main assembly 100 through the opening 80 in the direction indicated by the arrow mark D2, as shown in FIG. 25. FIG. 30 is a partially cutaway perspective view of the image forming apparatus after the cartridge tray 13 has been pulled out of the apparatus main assembly 100 to its outermost position.

Next, the case in which any cartridge or cartridges 50 are mounted into the apparatus main assembly 100 will be described. Referring to FIG. 25, the cartridge tray 13 is to be pushed into the apparatus main assembly 100 in the direction of the arrow mark D1 through the opening 80, with the door 12 kept in the open position. Thereafter, the door 12 is to be moved into the shut position as shown in FIG. 23. As the door 12 is moved, each of the projection 15 of the door 12 moves in the counterclockwise direction about the rotational axis 12*a*, while moving in the corresponding elongated hole 14*c* of the tray supporting member 14, to the bottom end 14*c*2 of the elongated hole 14*c*, as shown in FIG. 23. Thus, the tray supporting member 14 is moved in the direction of the arrow mark z2 (FIG. 23) by the pair of projections 15. Therefore, as the door 12 is moved into the shut position as shown in FIG. 23, the projections 14*d*1 and 14*d*2 are guided by the horizontal section 107*a*1, diagonal section 107*a*2, and horizontal section 107*a*3, in the listed order, as shown in FIG. 23. Therefore, the tray supporting members 14 move, first, in the direction of the arrow mark z2 (FIG. 23), and then, in the direction of the arrow mark y2 (FIG. 23), that is, the direction to move closer to the transfer belt 19.

{Positioning of Process Cartridge Relative to Electrophotographic Image Forming Apparatus Main Assembly}

Next, referring to FIGS. 5-8, 23-25, and 30, the positioning of the cartridge 50 in the apparatus main assembly 100 will be described. Referring to FIGS. 5 and 30, the apparatus main assembly 100 is provided with multiple pairs (four pairs in this embodiment) of cartridge positioning portions 101*a* for positioning a cartridge 50 relative to the apparatus main assembly 100. That is, each cartridge compartment of the cartridge tray 13 is provided with a pair of cartridge positioning portions 101*a*, which are located at the lengthwise ends of the corresponding compartment, one for one, in terms of the direction parallel to the lengthwise direction of the cartridge 50, in a manner to sandwich the transfer belt 19. Next, referring to FIGS. 6 and 23, as the door 12 is moved from the opening position to the shut position, the cartridge tray 13 and cartridges 50 move in the direction indicated by an arrow mark y2 (FIG. 23), causing the drum unit positioning portion 31*b*, with which the drum unit 31*y* is provided, to come into contact with the corresponding cartridge positioning portion 101*a* of the apparatus main assembly 100. As a result, the cartridge 50*y* is positioned relative to the apparatus main assembly 100.

At this time, a releasing member 75, which is moved by the movement of the door 12, will be described. Referring to FIGS. 23-25, as the door 12 is moved from the open position to the shut position, the tray supporting member 14 is moved by the direction indicated by the arrow mark y2 (FIG. 23). This movement of the tray supporting members 14 causes the projection 31*b*, with which the drum unit frame 34 is provided, to be properly positioned by the positioning portion 101*a* of the apparatus main assembly 101, as shown in FIG. 6.

Figure 6:
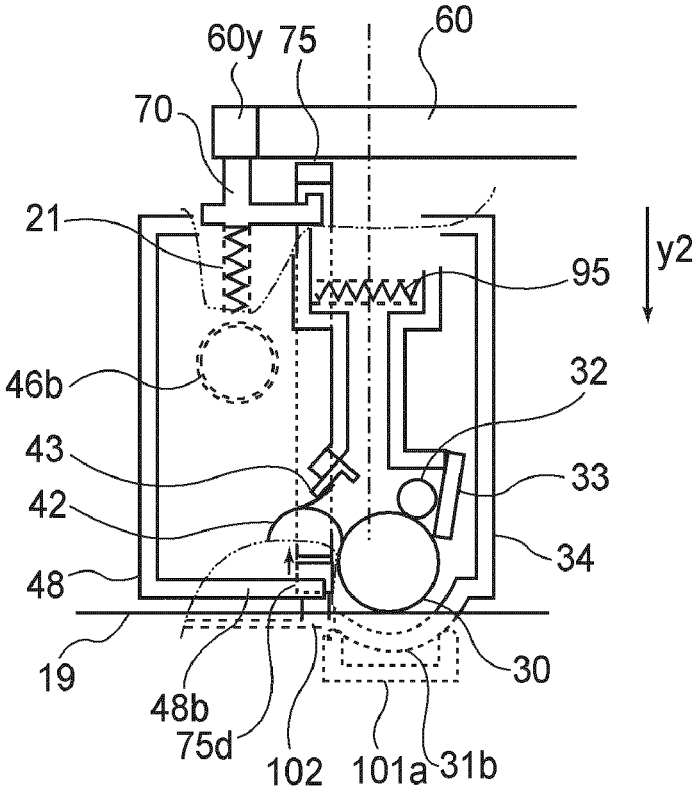
FIG. 6 is a schematic sectional view of one of the process cartridges, and its adjacencies, in the electrophotographic image forming apparatus in the first embodiment of the present invention, at a plane perpendicular to the axial line of the photosensitive drum.

Referring to FIGS. 5 and 6, as the tray supporting member 14 and cartridges are moved in the direction indicated by the arrow mark y2, a releasing member pushing member 102, which is firmly attach to the apparatus main assembly 100, pushes up the releasing member 75, with which the cartridge 50 is provided. The releasing mechanism of the releasing member 75 will be described later in detail.

{Development Roller Separating Mechanism of Electrophotographic Image Forming Apparatus Main Assembly}

Next, referring to FIGS. 5-8, 10, 13, and 14, the mechanism for moving the force receiving member 70, with which the cartridge 50*y* is provided, will be described. FIGS. 5-8 are schematic sectional views of the cartridge 50*y* in the apparatus main assembly 100, at a plane perpendicular to the axial line of the photosensitive drum 30, and FIG. 10(*a*) is a detailed perspective view of the cartridge 50*y*, as seen from the side from which the cartridge 50*y* is driven. FIGS. 13 and 14 are detailed perspective views of a part of the development unit 41.

As described above, as the door 12 is moved from the open position to the shut position, the drum frame projection 31*a* of the cartridge 50*y* is moved in the direction indicated by the arrow mark y2 (FIG. 6), being thereby positioned by the positioning portion 101*a* of the apparatus main frame 100. During this movement of the drum frame projection 31*a*, the bottom end portion 75*d* (portion of contact) of the releasing member 75 comes into contact with the releasing member pushing member 102. Thus, the releasing member 75 is pushed in the opposite direction from the direction indicated by the arrow mark y2, being therefore pushed up. That is, as the door 12 is closed, the releasing member 75 receives external force (second external force) from the releasing member pushing member 102. Next, referring to FIGS. 5 and 13, initially, the releasing member 75 is in contact with the force receiving member 70. However, as the releasing member 75 is pushed up, it becomes separated from the force receiving member 70. As a result, the force receiving member 70 rotates about the rotational axle 70*g* (FIG. 13), with which the force receiving member 70 is provided, in a manner to rotate from its standby position, shown in FIG. 5, outward of the development unit 41, that is, the direction to move away from the rotational axis 46*b* of the development unit 41, as shown in FIGS. 6 and 14.

Next, the operation of the force applying first member 60 will be described.

Referring to FIGS. 1 and 3, in terms of the vertical direction of the apparatus main assembly 100, the force applying first member 60 is positioned so that after the proper positioning of the each cartridge 50 in the apparatus main assembly 100, the force applying first member 60 is above the cartridge 50. In terms of the direction parallel to the axial line of the photosensitive drum 30, the force applying first member 60 is positioned so that it is enabled to come into contact with the force receiving portion 70*a* of the force receiving member 70 which is at the corresponding lengthwise ends of the cartridge 50.

Figure 27:
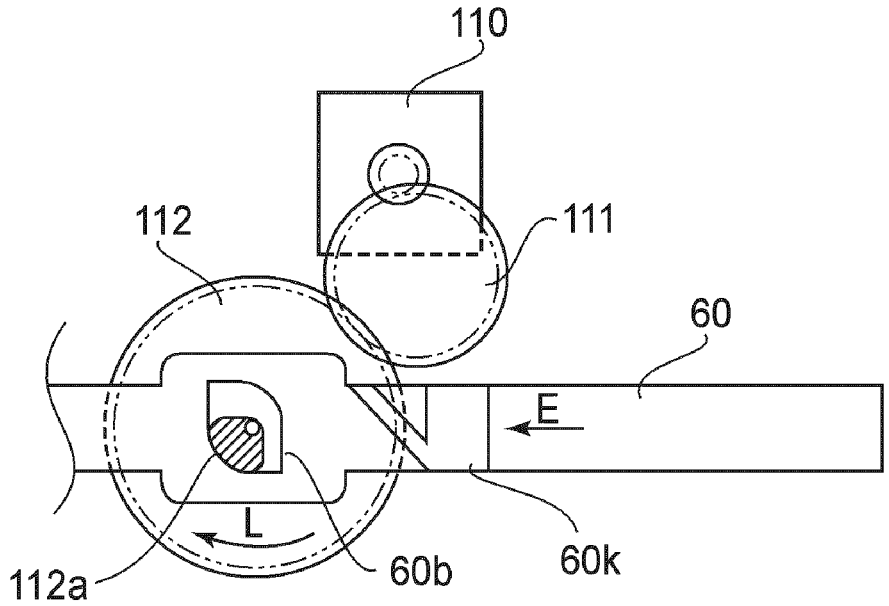
FIG. 27 is a schematic drawing of the force applying first member in the first embodiment of the present invention, showing the operation of the force applying member.
Figure 28:
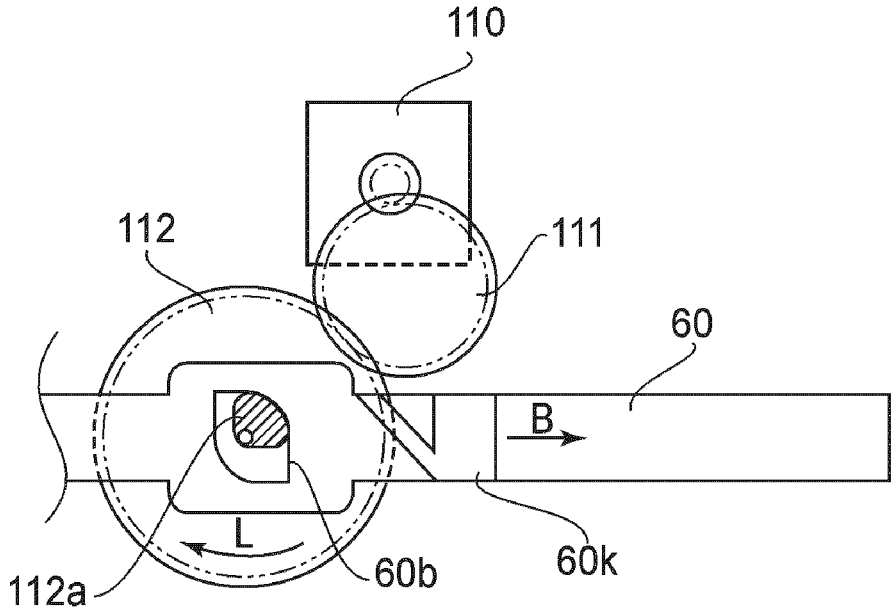
FIG. 28 also is a schematic drawing of the force applying first member in the first embodiment of the present invention, showing the operation of the force applying first member.
Figure 29:
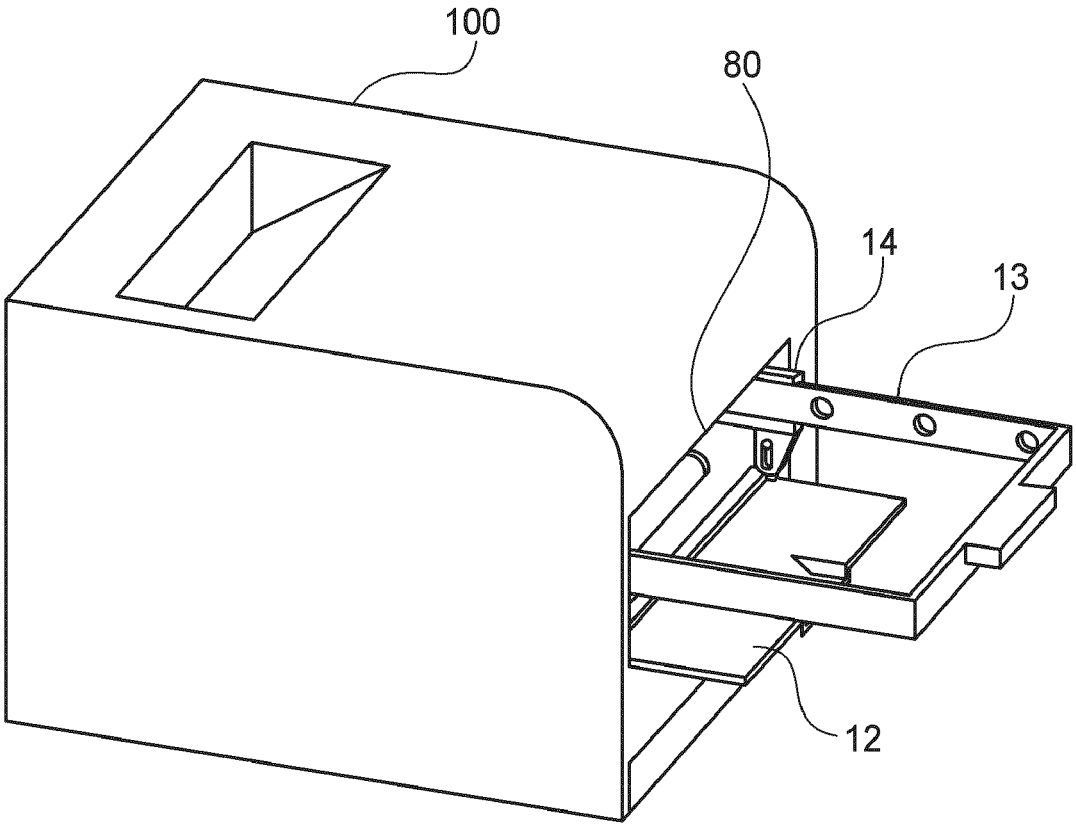
FIG. 29 is a perspective view of the electrophotographic image forming apparatus in the first embodiment of the present invention.

Referring to FIGS. 27 and 28, driving force is transmitted from a motor 110 (mechanical power source) with which the apparatus main assembly 100 is provided, to a gear 112 through a gear 111. As the driving force is transmitted to the gear 112, the gear 112 rotates in the direction indicated by an arrow mark L, rotating thereby the cam portion 112*a*, which is an integral part of the gear 112, in the direction indicated by the arrow mark L. The cam portion 112*a* is in contact with the moving force receiving portion 60*b*, with which the force applying first member 60 is provided. Therefore, as the cam portion 112*a* rotates, the first applying first member 60 is moved in the direction indicated by an arrow mark E or B.

Figure 7:
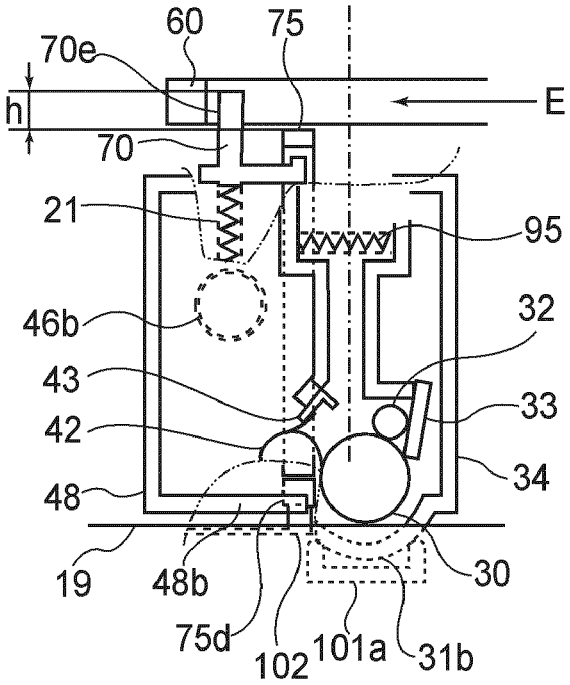
FIG. 7 is a schematic sectional view of one of the process cartridges, and its adjacencies, in the electrophotographic image forming apparatus in the first embodiment of the present invention, at a plane perpendicular to the axial line of the photosensitive drum.
Figure 8:
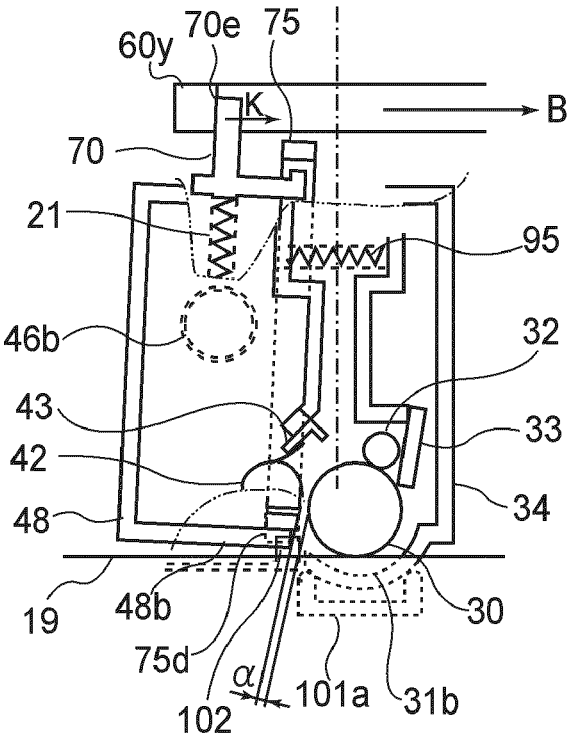
FIG. 8 is a schematic sectional view of one of the process cartridges, and its adjacencies, in the electrophotographic image forming apparatus in the first embodiment of the present invention, at a plane perpendicular to the axial line of the photosensitive drum.

FIG. 27 shows the force applying first member 60 after it has moved in the direction indicated by the arrow mark E. When the force applying first member 60 is in the state shown in FIG. 27, the development roller 42 and photosensitive drum 30 are still in contact with each other (FIG. 7). FIG. 28 shows the force applying first member 60 after it has moved in the direction indicated by the arrow mark B. When the force applying first member 60 is in the state shown in FIG. 28, the force receiving member 70 is in contact with the rib 60*y*, and therefore, it receives force from the force applying first member 60. As the force receiving member 70 receives force from the force applying first member 60, it rotationally moves the development unit 41 about the rotational axis 46*b*, causing the development roller 42 to separate from the photosensitive drum 30 (FIG. 8). This position of the development unit 41, shown in FIG. 28, will be referred to as the separation position of the development unit 41.

While each cartridge 50 is moved into the apparatus main assembly 100, the force receiving member 70 of the cartridge 50 remains in the standby position (FIG. 5). Therefore, the force applying first member 60 can be positioned significantly closer to the cartridge path in the apparatus main assembly, without allowing the force applying first member 60 and cartridge 50 to interfere with each other during the mounting of the cartridge 50, compared to the force applying member of an image forming apparatus in accordance with the prior art, making it possible to minimize the wasted space, and therefore, making it possible to significantly reduce the apparatus main assembly 100 in vertical dimension.

{Description of Mounting of Process Cartridge into Electrophotographic Image Forming Apparatus Main Assembly, and Force Receiving Member}

Next, the operational sequence from the beginning of the mounting of the cartridge 50 into the apparatus main assembly 100, to the separation of the development roller 42 from the photosensitive drum 30, will be described.

Referring to FIG. 4, it is after the cartridge tray 13 is pulled out of the apparatus main assembly 100 to its outermost position, that each cartridge 50 can be mounted into, or removed from, the cartridge tray 13 in the vertical direction, which is indicated by the arrow mark C.

After the mounting of the cartridge(s) 50 into the cartridge tray 13, the cartridge tray 13 is to be moved into the apparatus main assembly 100 in the direction indicated by the arrow D1, through the opening 80. That is, in this embodiment, each cartridge 50 is horizontally moved into the apparatus main assembly 100, from the direction which is intersectional (roughly perpendicular) to the axial line of the photosensitive drum 30.

Referring to FIG. 3, the cartridge 50*y* is mounted most downstream in the cartridge tray 13 in terms of the direction in which the cartridge tray 13 is moved (mounted) into the apparatus main assembly 100. That is, the cartridge 50*y* moves below the ribs 60*k*, 60*c*, and 60*m* of the force applying first member 60 from upstream to downstream.

Also in terms of the direction in which the cartridge tray 13 is into the apparatus main assembly 100, the cartridge 50*m* is mounted in the second cartridge compartment from the downstream end of the cartridge tray 13. Thus, when the cartridge tray 13 is mounted into the apparatus main assembly 100, the cartridge 50*m* is moved below the ribs 60*k* and 60*c* of the force applying first member 60, which act on the cartridge 50*k* and 50*c*, from upstream to downstream. Also in terms of the direction in which the cartridge tray 13 is into the apparatus main assembly 100, the cartridge 50*c* is mounted in the third cartridge compartment from the downstream end of the cartridge tray 13. Thus, when the cartridge tray 13 is mounted into the apparatus main assembly 100, the cartridge 50*c* is moved below the ribs 60*k* of the force applying first member 60, which acts on the cartridge 50*k*, from upstream to downstream.

Moreover, in terms of the direction in which the cartridge tray 13 is into the apparatus main assembly 100, the cartridge 50*k* is mounted in the most upstream cartridge compartment from the downstream end of the cartridge tray 13. Thus, as the cartridge tray 13 is mounted into the apparatus main assembly 100, the cartridge 50*k* is moved deep enough into the apparatus main assembly 100 for the force receiving member 70 to move under the force applying portion 60*k* of the force applying first member 60, which acts on the cartridge 50*k*, from upstream to downstream.

If the cartridge 50 were designed so that its force receiving member 70 remains projecting while the cartridge 50 is moved into the apparatus main assembly 100, the force applying first member 60 would have to be positioned higher than where it is in this embodiment, in order to prevent the force receiving member 70 and force applying first member 60 from interfering with each other. In this embodiment, however, the cartridge 50 is designed so that the force receiving member 70 is kept in its standby position, that is, the position in which it does not project from the cartridge 50. Therefore, the force applying first member 60 can be positioned closer to the cartridge path, because the distance by which the force receiving member 70 projects does not need to be taken into consideration. In other words, designing the cartridge 50 so that its force receiving member 70 remains in its standby position while the cartridge 50 is mounted into the apparatus main assembly 100 makes it possible to reduce the apparatus main assembly 100 in vertical dimension.

Thus, in this embodiment, when the cartridge tray 13, which is holding the cartridges 50, is moved into the apparatus main assembly 100, there are a gap f1 between the force applying first member 60 and force receiving member 70, and a gap f2 between the photosensitive drum 30 and transfer belt 19, as shown in FIG. 5, preventing thereby each cartridge 50 and apparatus main assembly 100 from interfering with each other while the cartridge 50 is mounted into the apparatus main assembly 100.

Referring to FIGS. 23-25, after the cartridge tray 13 is pushed all the way into the apparatus main assembly 100, the door 12 is to be moved into the shut position. As the door 12 is moved into the shut position, the tray supporting members 14 are moved toward the transfer belt 19 (direction indicated by arrow mark y2). Hereafter, the vertical component of this movement of the tray supporting members 14 in the direction indicated by the arrow mark y2 will be referred to as a distance f2. As the tray supporting members 14 are moved in the direction indicated by the arrow mark y2, the cartridges 50 are moved toward the transfer belt 19 by the movement of the tray supporting members 14, causing thereby the peripheral surface of the photosensitive drum 30 in each cartridge 50 to come into contact with the surface of the transfer belt 19, as shown in FIG. 6. Thus, by the time the peripheral surface of the photosensitive drum 30 comes into contact with the surface of the transfer belt 19, the gap f1 between the force receiving apparatus 70 and force applying first member 60 widens to the sum of the gaps f1 and f2.

Further, referring to FIG. 6, as the door 12 is moved into the shut position, the cartridge positioning member 31*b* of each cartridge 50 comes into contact with the corresponding cartridge positioning portion 101*a*, with which the apparatus main assembly 100 is provided, properly positioning thereby the cartridge 50 relative to the apparatus main assembly 100.

As described above, the restriction upon the movement of the force receiving member 70 by the releasing member 75 is removed by the function of the releasing member pushing member 102, with which the apparatus main assembly 100 is provided. Thus, as the restriction placed on the force receiving member 70 by the releasing member 75 is removed, the force receiving member 70 rotates from its standby position in the direction to make its force receiving portion 70*a* move out of (project from) the development unit 41 of the cartridge 50*y*, that is, in the direction to move away from the rotational axis 46*b* of the development unit 41, as shown in FIG. 6.

However, as the force receiving member 70 rotates as described above, the top surface of the force receiving member 70 comes into contact with the bottom surface of the rib 60*y* of the force applying first member 60. As a result, the movement of the force receiving member 70 is regulated by the rib 60*y* (state shown in FIG. 6). This position of the force receiving member 70 will be referred to as the intermediate position.

In this embodiment, a position of the force applying first member 60, which corresponds to the above described intermediate position of the force receiving member 70, is made to be the home position of the force applying first member 60. This is for the following reason. That is, while the image forming apparatus is not used for image formation after the mounting of the cartridges 50, each cartridge 50 remains in the state shown in FIG. 8, that is, the state in which the force applying first member 60 has moved in the direction indicated by the arrow mark B, and the force receiving member 70 has come into contact with the rib 60*y*, being thereby prevented from moving further. It is in this state that the photosensitive drum 30 and development roller 42 remain separated from each other. That is, it is in this state, shown in FIG. 8, in which the photosensitive drum 30 and development roller 42 remain separated from each other, that the cartridge 50 is removed from the apparatus main assembly 100. Thus, when the cartridge 50 is mounted into the apparatus main assembly 100 next time, the force receiving member 70 comes into contact with the rib 60*y*, because the force applying first member 60 is in the position shown in FIG. 8. Therefore, as the force receiving member 70 is rotated out of its standby position, it comes into contact with the bottom surface of the rib 60*y*, as shown in FIG. 6.

Incidentally, the surface of the force receiving member 70, by which the force receiving member 70 receives external force (first external force) from the force applying first member 60, faces the direction from which each cartridge 50 is moved into the apparatus main assembly 100. Making the force receiving surface of the force receiving member 70 face in the above described direction ensure that as the force receiving member 70 receives force from the force applying first member 60, the development unit 41 is efficiently moved relative to the photosensitive drum 30, and also, that the photosensitive drum 30 and development roller 42 are kept separated from each other.

As the force applying first member 60 is moved from the position shown in FIG. 6 to the position shown in FIG. 7 in the direction indicated by the arrow mark E, the force receiving portion of the force receiving member 70 is rotated farther outward of the cartridge 50*y*, entering thereby the path of the rib 60*y*. This position of the force receiving member 70, that is, the position in which the force receiving portion of the force receiving member 70 has moved all the way into the path of the rib 60*y*, will be referred to as the protrusive position (active position). That is, when the force receiving member 70 is in its protrusive position, it projects more from the cartridge 50*y* than it is in its standby position or intermediary position, which is obvious. In order for the force receiving member 70 to come into contact with the fore applying first member 60 when the cartridge 50 is moved into the apparatus main assembly 100, the distance by which the force receiving member 70 projects when the force receiving member 70 is in the protrusive position needs to be greater than the sum of the gaps f1 and f2. Further, the operation of the force applying first member 60 is started after the mounting of each cartridge 50 into the apparatus main assembly 100, and immediately before the starting of the next image forming operation.

Next, the force applying first member 60 is moved in the direction indicated by the arrow mark B as shown in FIG. 8. As the force applying first member 60 is moved, the lateral surface 70*e* of the force receiving member 70, that is, the force applying first member contacting surface of the force receiving member 70 which is in the path of the force applying first member 60, receives the external force (first external force) from the rib 60*y* of the force applying first member 60. As a result, the development unit 41 is rotationally moved about the rotational axis 46*b* (shaft), causing the development roller 42 to separate from the photosensitive drum 30 by a distance of $\alpha$.

Thus, when an image forming operation is carried out next time, the force applying first member 60 is to be moved in the direction indicated by the arrow mark E to place the development roller 42 in contact with the photosensitive drum 30. As the force applying first member 60 is moved in the direction indicated by the arrow mark E, the force receiving member 70 becomes separated from the force applying first member 60, stopping thereby receiving force from the rib 60*y*, as shown in FIG. 7. Consequently, the development roller 42 is placed in contact with the photosensitive drum 30 by the resiliency of the spring 95 placed between the development unit 41 and drum unit 31, readying thereby the cartridge 50*y* for image formation. It should be noted here that the rotation of the photosensitive drum 30 is started before the development roller 42 is placed in contact with the photosensitive drum 30. Further, the development roller 42, which rotates by receiving driving force from the apparatus main assembly 100 through the coupling portion 67*a*, also begins to be rotated before the development roller 42 is placed in contact with the photosensitive drum 30, for the following reason. That is, with both the rotation of the photosensitive drum 30 and rotation of the development roller 42 started before the placement of the development roller 42 in contact with the photosensitive drum 30, the difference in the peripheral velocity between the photosensitive drum 30 and development roller 42 is significantly smaller than otherwise. Therefore, the cartridge 50 in this embodiment is significantly smaller in the frictional wear which occurs to the photosensitive drum 30 and development roller 42 when they are placed in contact with each other than a process cartridge structured otherwise. It should be noted here that this arrangement regarding the timing of the starting of the rotation of the photosensitive drum 30 and development roller 42 is possible because the cartridge 50 is structured so that the axial line of the cylindrical portion 46*b* coincides with that of the coupling portion 67*a*, in order to ensure that even when the development unit 41 is rotationally moved about the cylindrical portion 46*b*, the coupling portion 67*a* does not change in position. After the completion of image formation, the development roller 42 is separated from the photosensitive drum 30 by moving the force applying first member 60 in the direction indicated by the arrow mark B as described above. It is after the separation of the development roller 42 from the photosensitive drum 30 that the rotation of the development roller 42 and photosensitive drum 30 is stopped. Therefore, the cartridge 50 in this embodiment is significantly smaller in the difference in peripheral velocity between the photosensitive drum 30 and development roller 42, being therefore significantly smaller in the amount of the frictional wear which occurs, when the development roller 42 is separated from the photosensitive drum 30, than a process cartridge structured otherwise. Consequently, the electrophotographic image forming apparatus in this embodiment is significantly superior in image quality to a comparable image forming apparatus in accordance with the prior art.

{Relationship Between Force Receiving Member and Releasing Member}

Figure 15:
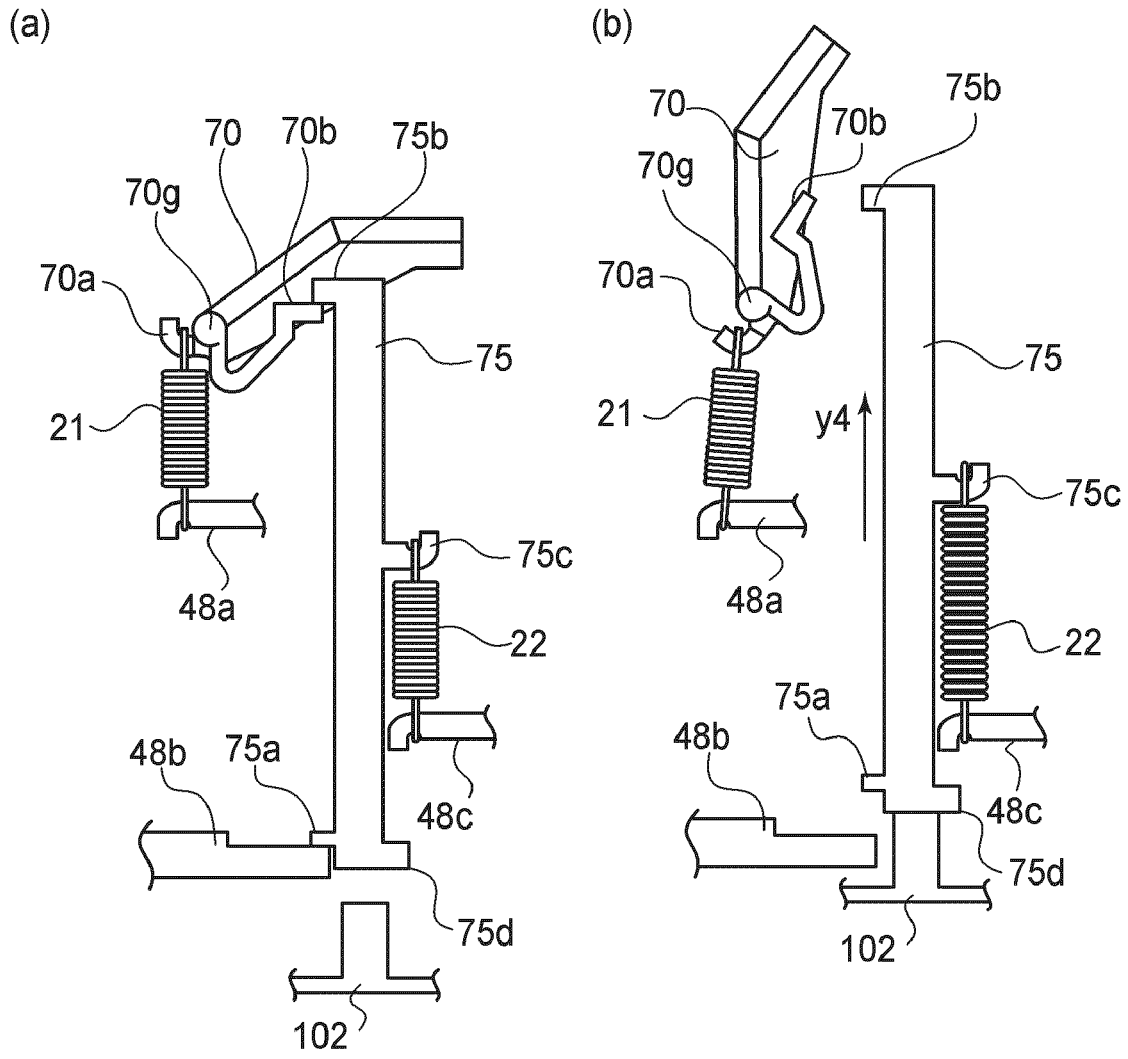
FIGS. 15(*a*) and 15(*b*) are detailed schematic drawings of the force receiving member and releasing member in the first embodiment of the present invention, showing in detail the mechanical structure thereof.

Next, referring to FIGS. 5-6, 13-15(*b*), the relationship between the force receiving member 70 and releasing member 75 will be described. FIGS. 15(*a*) and 15(*b*) are detailed schematic drawings of the force receiving member and releasing member 75, showing the mechanical structure for releasing the force receiving member 70.

Referring to FIG. 2, the cartridge 50*y* is provided with the force receiving member 70, which is for placing the development roller 42 and photosensitive drum 30 in contact with each other, or separating them from each other, in the apparatus main assembly 100. Next, referring to FIGS. 13 and 15(*a*), the force receiving member 70 is provided with a hook portion 70*a*, to which the tension spring 21 is attached as a tension generating member, by one of its lengthwise ends. The other end of the tension spring 21 is attached to the hook portion 48*a* of the development unit frame 48. Thus, the force receiving member 70 remains under the tension of the tension spring 21, which works in the direction to pull the force receiving member 70 from the standby position to the protrusive position. Referring also to FIGS. 13 and 15(*a*), the force receiving member 70 is provided with the force receiving portion 70*e* (FIGS. 7 and 8) and the contact portion 70*b*. The force receiving portion 70*e* is the portion of the force receiving member 70, by which the force receiving member 70 receives external force from the force applying first member 60. The contact portion 70*b* is the portion of the force receiving member 70, with which the releasing member 75 comes into contact. While the contact portion 70*b* is in contact with the contact portion 75*b* with which the releasing member 75 is provided, the force receiving member 70 is prevented from rotationally moving from the standby position to the protrusive position.

Referring also to FIGS. 13 and 15(*a*), the releasing member 75 is provided with a hook portion 75*c*, to which the second tension spring 22 is attached by one of its lengthwise ends. The other end of the second tension spring 22 is connected to the hook portion 48*c*, with which the development unit frame 48 is provided. Thus, the releasing member 75 is kept pulled in the direction indicated by an arrow mark y3 (FIG. 3). Further, the development unit frame 48 is provided with a releasing member regulating portion 48*b*, which is for regulating the movement of the releasing member 75 which remains pulled in the abovementioned direction indicated by the arrow mark y3.

Next, the movement of the force receiving member 70 from its standby position to its protrusive position will be described.

Referring to FIGS. 5, 6, and 13-15(*b*), when the cartridge 50 is properly positioned relative to the apparatus main assembly 100 by the cartridge positioning portion 101*a* of the apparatus main assembly 100, the releasing member pushing member 102, which is solidly attached to the image forming apparatus main frame, comes into contact with the contact portion 75*d* of the releasing member 75, and presses on the contact portion 75*d*. Thus, the releasing member 75 moves in the direction indicated by an arrow mark y4 (FIG. 14), causing its contact portion 75*b* to separate from the contact portion 70*b* of the force receiving member 70. As a result, the force receiving member 70 is rotationally moved from its standby position to its protrusive position by the resiliency (tension) of the tension spring 21.

In the following mathematical expressions, f3, f4, f4, and g stand for the amount of the resiliency of the tension spring 21, amount of the resiliency of the tension spring 22, amount of the force by which the cartridge 50 is pushed (positioned) upon the cartridge positioning portion 101*a* of the main assembly frame, and self weight of the cartridge 50, respectively. In this embodiment, in order to prevent the releasing member 75 from releasing the force receiving member 70, the relationship among the abovementioned forces is set as follows: F3 is made to be greater than f4 (f3>f4). The amount of the upward force, which the cartridge 50 receives as the releasing member 75 is pressed by the releasing member pushing member 102 solidly fixed to the main assembly frame, is f4, whereas the downward force which the cartridge 50 receives as the releasing member 75 is pressed by the releasing member pushing member 102, equals the sum of f3, f5, and g, that is, (f3+f5+g). Thus, the force receiving member 70, releasing member 75, springs 21, and spring 22 are designed to satisfy the following inequality: f4<f3+f5+g. Therefore, it does not occur that the releasing member 75 releases the force receiving member 70 when the cartridge 50 is not in the apparatus main assembly 100, and also, that the cartridge 50 floats from the cartridge positioning portion 101*a* of the apparatus main assembly 100 after it is properly positioned in the apparatus main assembly 100.

Figure 17:
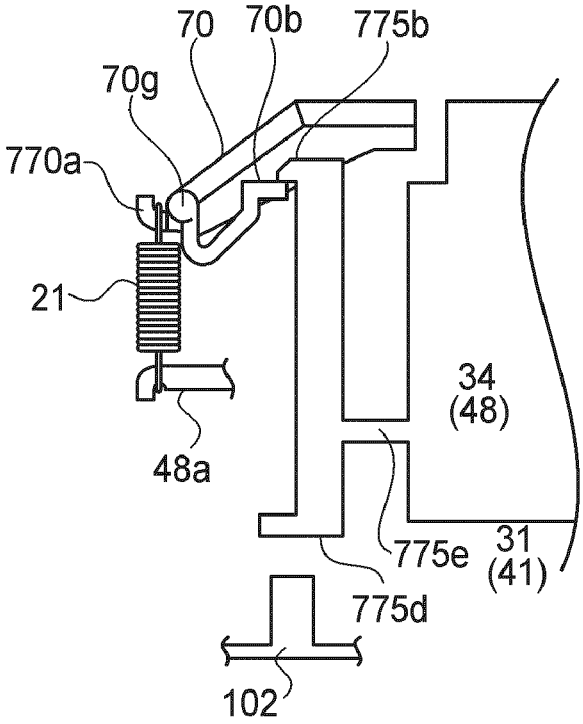
FIG. 17 is another detailed schematic drawing of the force receiving member and releasing member, in the first embodiment of the present invention, showing in detail the mechanical structure thereof.
Figure 18:
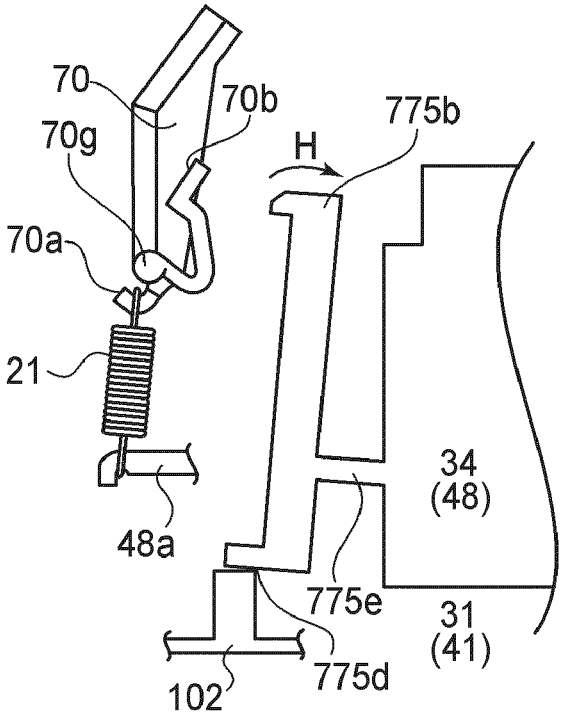
FIG. 18 is another detailed schematic drawing of the force receiving member and releasing member, in the first embodiment of the present invention, showing in detail the mechanical structure thereof.

In this embodiment, the releasing member 75 is provided with the contact portion 75*b* as a part of mechanism for releasing the contact portion 70*b* of the force receiving member 70. However, instead of providing the releasing member 75 with the contact portion 75*b*, the drum unit 31 or development unit 41 may be provided with a member, such as a contact portion 775*b* shown in FIGS. 17 and 18. In the case of the force receiving member releasing mechanism shown in FIGS. 17 and 18, the drum unit frame 34 which is one of the structural components of the drum unit 31, or development unit frame 48 which is one of the structural components of the development unit 41, is provided with the contacting portion 775*b*. In this case, as the cartridge 50 is mounted into the apparatus main assembly 100, the contact portion 775*b* is pushed by the releasing member pushing member 102 solidly fixed to the apparatus main assembly 100, in the direction indicated by an arrow mark in FIG. 18. More specifically, the contact portion 775*d* receives external force (second external force) from the releasing member pushing member 102. Therefore, the contact portion 775*b* moves in the direction indicated by an arrow mark H (FIG. 18), disengaging thereby from the contact portion 70*b* of the force receiving member 70. That is, the releasing member 775 is provided with an elastic connective portion 775*e*, by which the releasing member 775 is attached to the drum unit frame 34 or development unit frame 48. Therefore, as the force receiving portion 775*d* of the releasing member 75 is pushed by the releasing member pushing member 102, the connective portion 75*e* is deformed by the force received by the force receiving portion 775*d*. As a result, the contact portion 775*b* is moved away from the contact portion 70*b* of the force receiving member 70, allowing thereby the contact portion 70*b* to rotationally move as described above. In this case, the drum unit frame 34 or development unit frame 48 is provided with the releasing portion 775. However, the structural component other than the drum unit frame 34 or development unit frame 48 may be provided with the releasing portion 775. Further, in this embodiment, the releasing member pushing member 102 of the apparatus main assembly 100 is positioned below the corresponding cartridge compartment. However, the releasing member pushing member 102 may be positioned anywhere, as long as the location enables the releasing member pushing member 102 to push the releasing member 75 when the cartridge 50 is in the apparatus main assembly 100. Further, the releasing member pushing member 102 may be in any shape, as long as the shape enables the releasing member pushing member 60 to move the releasing member 70 by coming into contact with the releasing member 70. For example, it may be U-shaped in cross section, instead of being in the form of a projection as it is in this embodiment.

Figure 16:
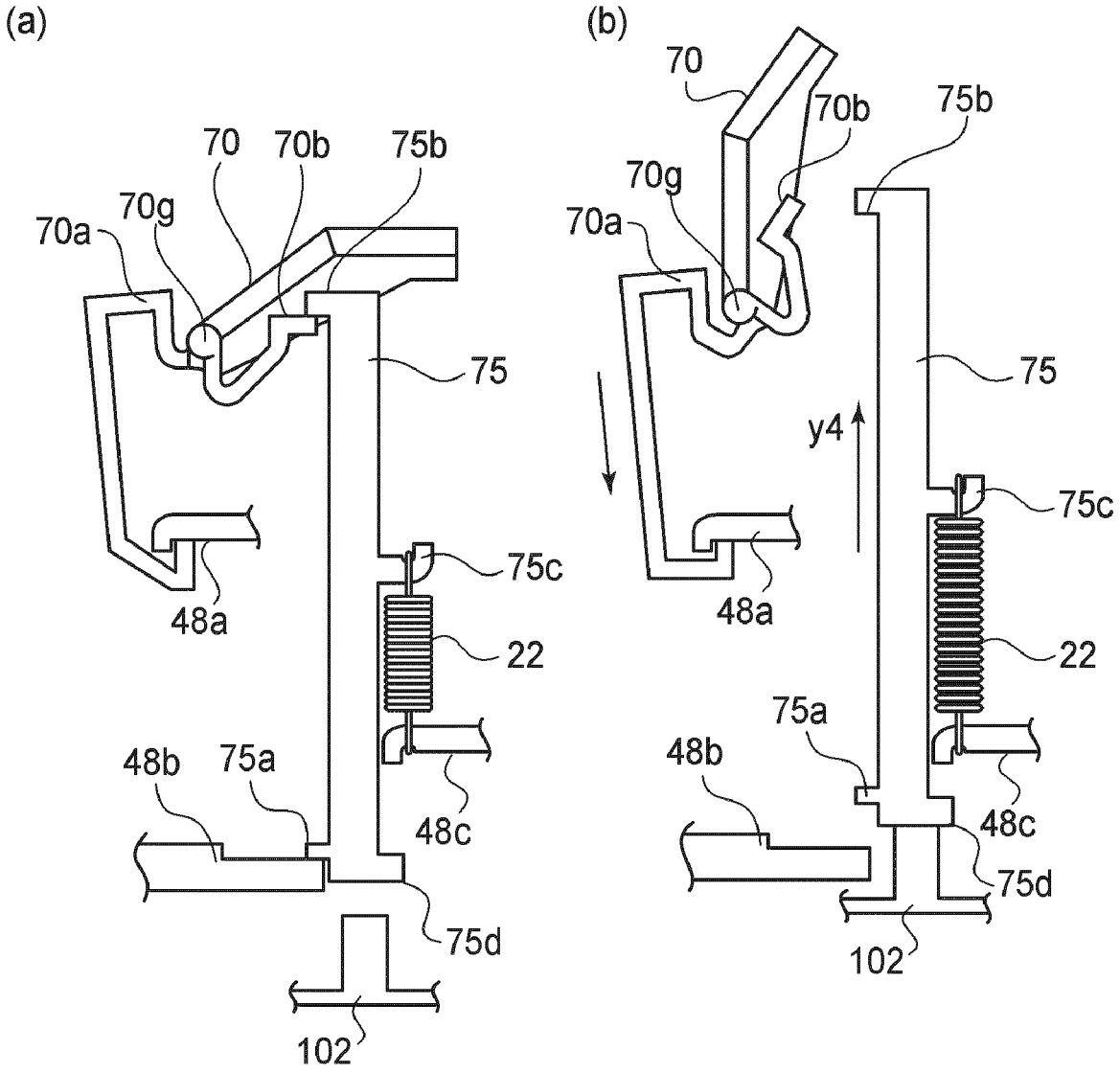
FIGS. 16(*a*) and 16(*b*) also are detailed schematic drawings of the force receiving member and releasing member in the first embodiment of the present invention, showing in detail the mechanical structure thereof.

Further, the tension spring 21 may be eliminated by extending the hook portion 70*a* of the force receiving member 70 so that the hook portion 70*a* itself can elastically deform and can be directly engaged with the hook portion 48*a* of the development unit frame 48, as shown in FIGS. 16 (16(*a*) and 16(*b*)).

Figure 19:
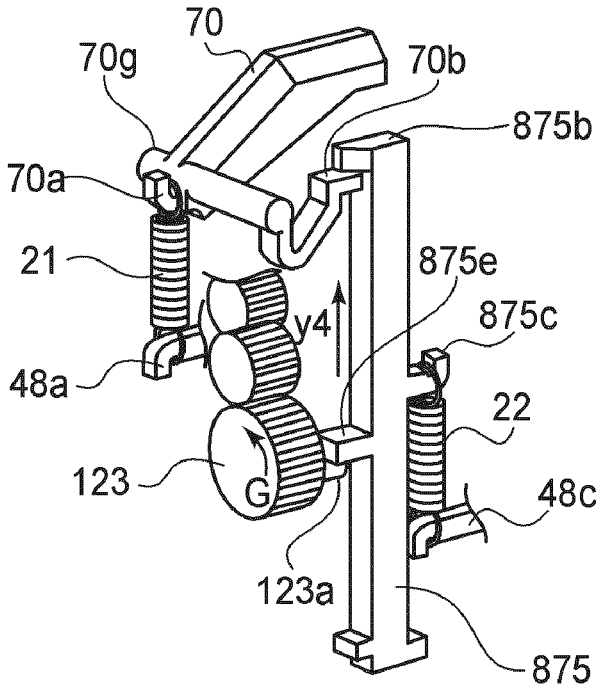
FIG. 19 also is a detailed schematic drawing of the force receiving member and releasing member in the first embodiment of the present invention, showing in detail the mechanical structure thereof.
Figure 20:
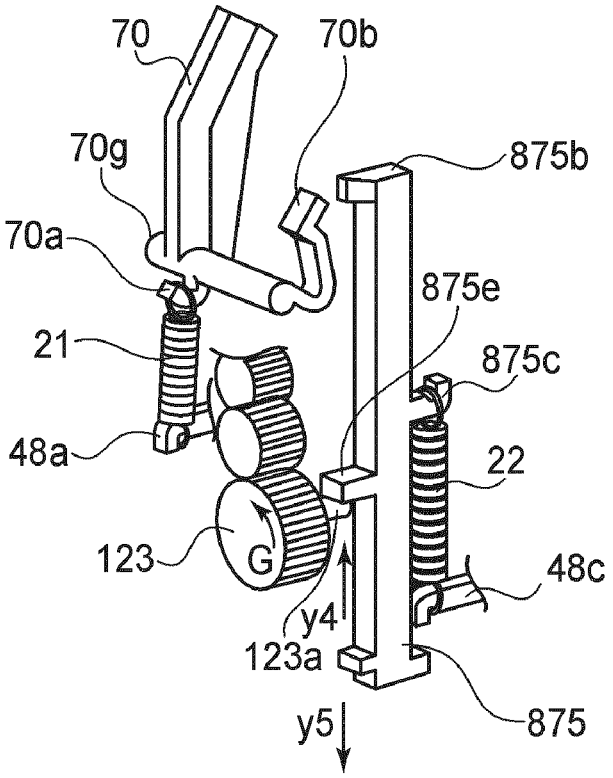
FIG. 20 is another detailed schematic drawing of the force receiving member and releasing member in the first embodiment of the present invention, showing in detail the mechanical structure thereof.

Further, referring to FIGS. 19 and 20, the releasing member 75 may be replaced with a releasing member, such as a releasing member 875 which can be moved by the utilizing the driving force, which the coupling member 67 of the development unit 41 receives from the apparatus main assembly 100. More specifically, the cartridge 50 is provided with a gear 123 having a projection 123*a* (pin) for pushing the releasing member pushing member 875 in the direction indicated by an arrow mark y4. Further, the releasing member 875 is provided with a contact portion 875*e* with which the abovementioned projection 123*a* (pin) comes into contact. Thus, as the gear 123 is rotated in the direction indicated by an arrow mark G by the abovementioned driving force, the projection 123*a* pushes up the contact portion 875*a* of the releasing member 875. As a result, the contact portion 875*b* of the releasing member 875 is disengaged from the contact portion 70*b* of the force receiving member 70, allowing thereby the force receiving member 70 to rotationally move into its protrusive position. As the projection 123*a* of the gear 123 is disengaged from the contact portion 875*a* of the releasing member 875, the releasing member 875 is pushed down (in the direction indicated by arrow mark y5) by the resiliency of the tension spring 22. Thereafter, as long as the driving force is transmitted to the cartridge 50, the gear 123 continues to rotates, but the projection 123*a* of the bear 123, and the contact portion 875*e* of the releasing member 875 do not come into contact with each other.

{Removal of Process Cartridge from Main Assembly of Electrophotographic Image Forming Apparatus}

Next, the operation for removing the cartridge 50 from the apparatus main assembly 100 will be described.

Referring to FIG. 24, as the door 12 is rotationally moved from the shut position to the open position, the tray supporting members 14 are moved upward, that is, in the direction (indicated by arrow mark y1) to be moved away from the transfer belt 19 as shown in FIG. 24. As a result, each cartridge 50 is moved upward with the cartridge tray 13, causing the photosensitive drum therein to separate from the transfer belt 19.

Figure 21:
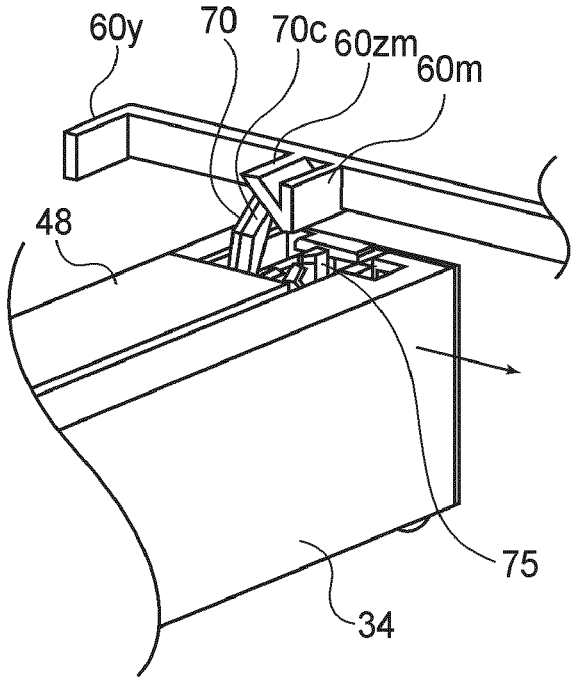
FIG. 21 is a schematic detailed drawing of the force receiving member in the first embodiment of the present invention, showing in detail the mechanical structure thereof.
Figure 22:
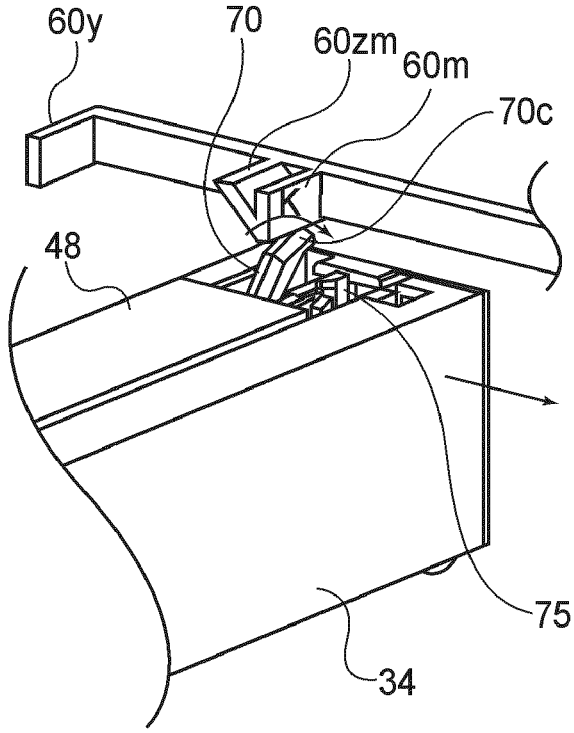
FIG. 22 is another detailed schematic drawing of the force receiving member in the first embodiment of the present invention, showing in detail the mechanical structure thereof.

Further, as the cartridge tray 13 is moved in the direction to be pulled out (direction indicated by arrow mark z1 in FIG. 24), the cartridge 50 changes in state from the one shown in FIG. 8 to the one shown in FIG. 7. That is, the force receiving member 70 stops being kept pressed by the force applying first member 60. When the cartridge 50 is in this state, that is, the state shown in FIG. 7, the force receiving member 70 is kept in the protrusive position by the resiliency of the tension spring 21, as shown in FIGS. 7 and 14. Referring to FIGS. 21 and 22, the force receiving member 70 is provided with a contact portion 70*c* having a slant surface, which is on the opposite side from the lateral surface 70*e* (FIG. 8) by which the force receiving member 70 receives force from the force applying first member 60.

As the tray supporting members 14 are pulled in the direction indicated by the arrow mark z1 (FIG. 24), the contact portion 70*c* comes into contact with the force receiving member returning portion 60*zm* of the force applying first member 60, which also has a slanted surface. Thus, as the tray supporting members 14 are pulled further, the force receiving member 70, which is in the protrusive position, is pushed down by the force receiving member returning portion 60*mz* in the direction indicated by an arrow mark K (FIG. 22), allowing thereby the force receiving member 70 to move under the rib 60*m*, allowing thereby the cartridge 50 to be moved outward of the apparatus main assembly 100. Then, the cartridge 50 is moved under the ribs 60*c* and 60*k*, and is moved out of the apparatus main assembly 100 through the opening 80.

When the cartridge 50 is mounted again into the image forming apparatus main assembly 100 after being removed therefrom, the force receiving member 70, which is in the protrusive position, can be moved back into the standby position by pressing down the force receiving member 70. This operation of pressing the force receiving member 70 back into its standby position can be easily carried out by a user, because both the releasing member 75, and the second tension spring 22 connected to the releasing member 75, are elastic.

In the case of the releasing member 875 which must be moved by the abovementioned driving force, the gear 123 must be rotated back into a preset position before the releasing member 875 can be moved back into the standby position. The releasing member 875 can be rotated back to the preset position by manually turning a gear connected to the gear 123, or with the use of a tool (driver or the like).

As described above, the electrophotographic image forming apparatus in this embodiment is structured so that as the door 12 is moved into its shut position after the mounting of the cartridge(s) 50 into the apparatus main assembly, the force receiving member 70, which is for moving the development unit 41, is rotated in the direction to make its contact portion 70*c* to project outward from the development unit 41.

Therefore, the cartridge 50 in this embodiment is significantly smaller than a cartridge in accordance with the prior art (which hereafter may be referred to simply as conventional cartridge). Further, while the cartridge 50 is mounted into the apparatus main assembly 100, the force receiving member 70 remains in its standby position. Therefore, the apparatus main assembly 100 in this embodiment can be made significantly smaller in the vertical dimension of the cartridge path than the apparatus main assembly of a conventional electrophotographic image forming apparatus. Therefore, the opening 80 can be made significantly smaller than the corresponding opening of a conventional electrophotographic image forming apparatus. Further, the force applying first member 60 can be positioned significantly closer to the cartridge path than the counterpart of a conventional electrophotographic image forming apparatus. Therefore, the apparatus main assembly 100 can be significantly reduced in its vertical dimension compared to the apparatus main assembly of a conventional electrophotographic image forming apparatus.

Further, before the cartridge 50 is mounted into the apparatus main assembly 100, the force receiving member 70 is in its standby position. Therefore, it is unlikely to be occur that the force receiving portion 70 is damaged while the cartridge 50 is handles by a user or transported alone.

Embodiment 2

In the first embodiment, the releasing member 75 is disengaged by the projection 102 (releasing member pushing member) solidly attached to the main assembly frame. In this embodiment, however, the cartridge is structured so that the releasing member moves by receiving force from the movable force applying second member, with which the apparatus main assembly is provided.

This embodiment also will be described with reference to a cartridge, more specifically, a cartridge 950*y*, which stores the yellow developer. Incidentally, the description of this embodiment will be centered around the structural features of the electrophotographic image forming apparatus in this embodiment, which are different from those in the first embodiment.

{Cartridge Tray of Main Assembly of Electrophotographic Image Forming Apparatus}

Next, referring to FIGS. 37-39, the operation of the cartridge tray 13 in this embodiment will be described.

Figure 37:
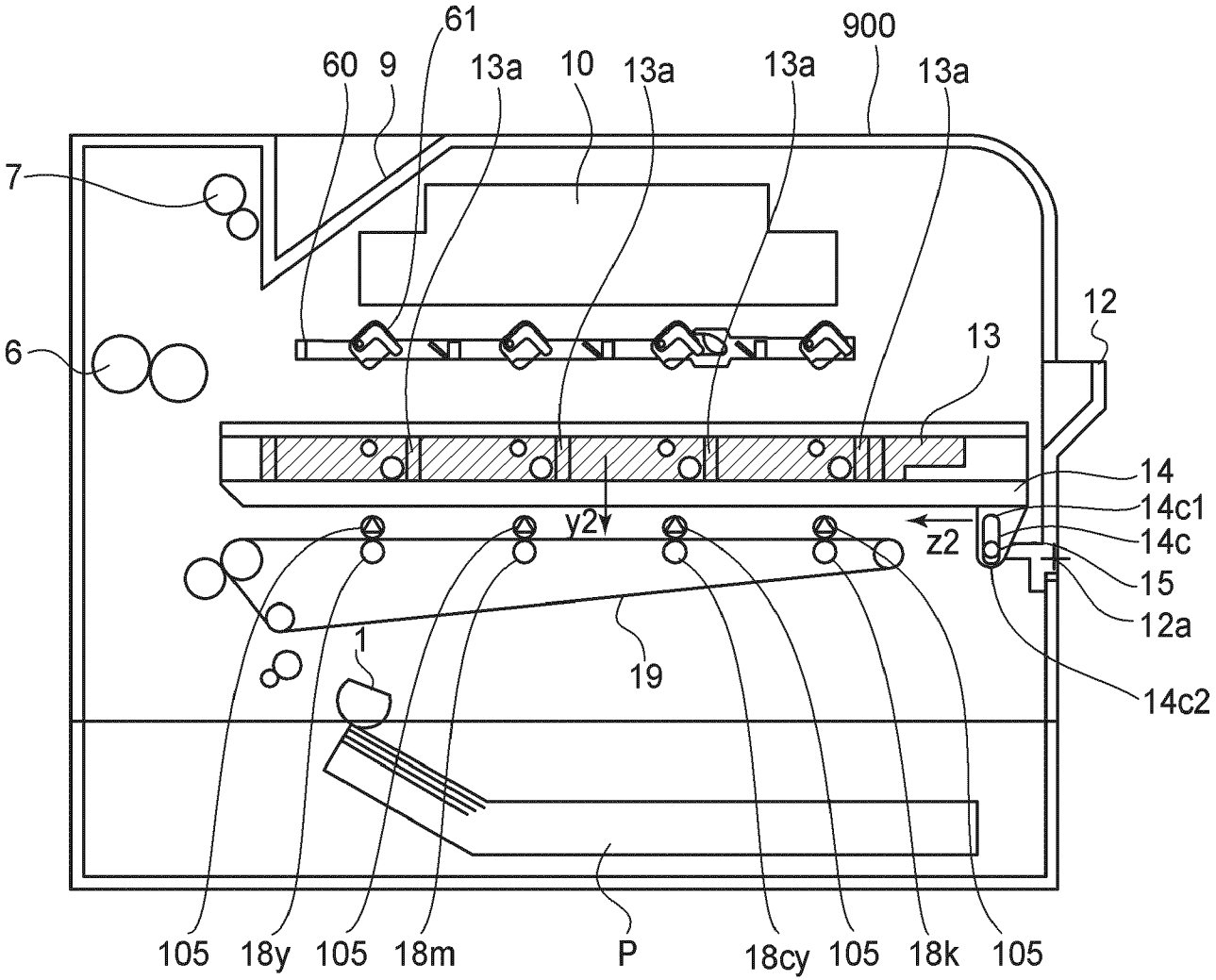
FIG. 37 is a schematic sectional view of the electrophotographic image forming apparatus in the second embodiment of the present invention, showing the general structure of the apparatus.
Figure 38:
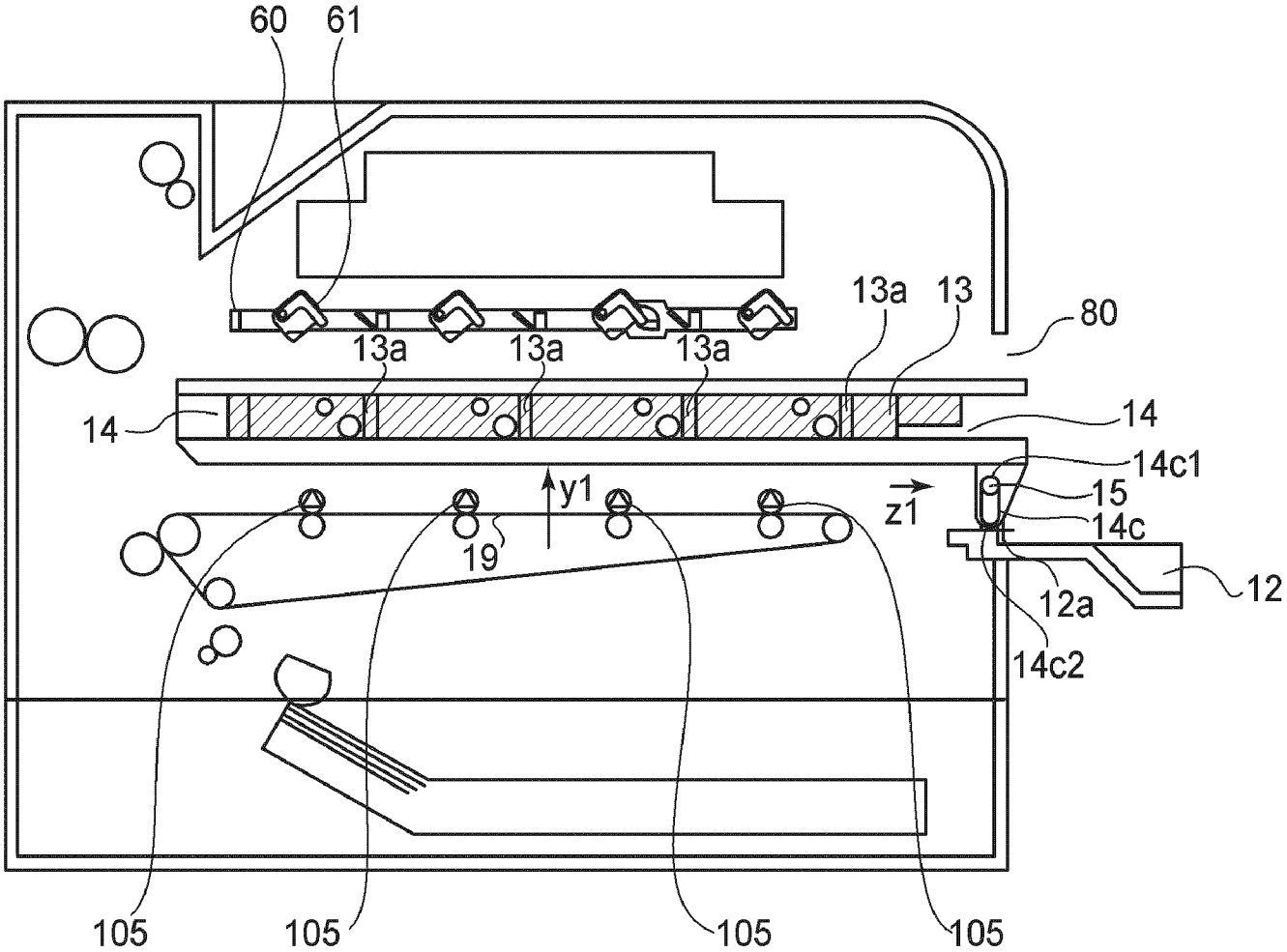
FIG. 38 also is a schematic sectional view of the electrophotographic image forming apparatus in the second embodiment of the present invention, showing the general structure of the apparatus.
Figure 39:
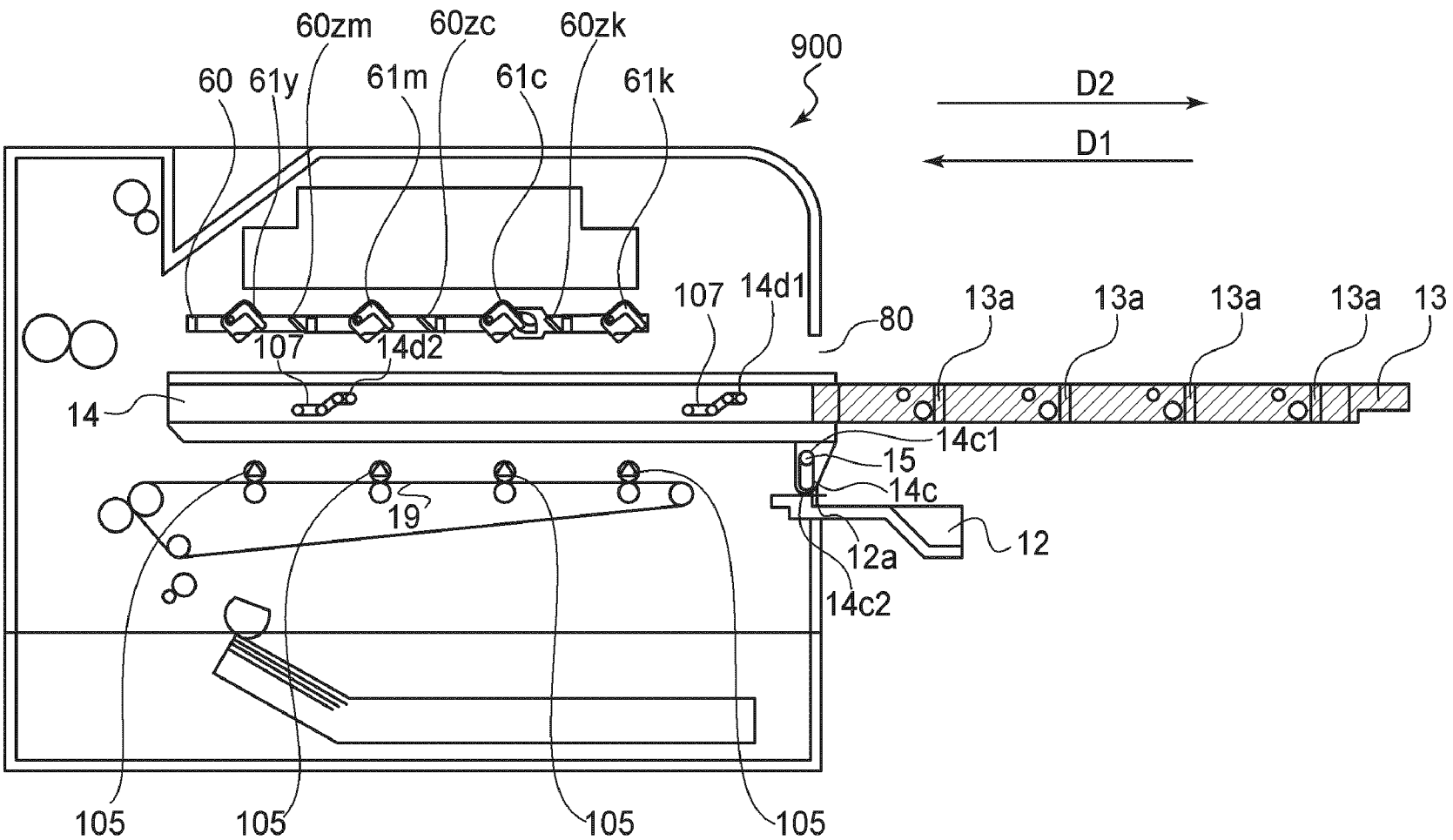
FIG. 39 is another a schematic sectional view of the electrophotographic image forming apparatus in the second embodiment of the present invention, showing the general structure of the apparatus.

In order to make it easier to understand the operation of the cartridge tray 13, the cartridges 50 are not shown in FIGS. 37-39.

The cartridge tray 13 is supported by a pair of tray supporting members 14 in such a manner that the cartridge tray 13 can be pulled out of the apparatus main assembly 100 while remaining supported by the tray supporting members 14. The tray supporting members 14 are moved by the movement of the door 12 which can be opened or closed by an operator (user). The door 12 is attached to the apparatus main assembly 900 so that it can be rotationally moved about its rotational axis 12*a* (shaft by which door 12 is held to apparatus main assembly 100). The door 12 is rotationally movable between a position (shut position) in which it completely covers an opening 80, as shown in FIG. 27, and a position (open position) in which it fully exposes the opening 80, as shown in FIG. 28.

Figure 42:
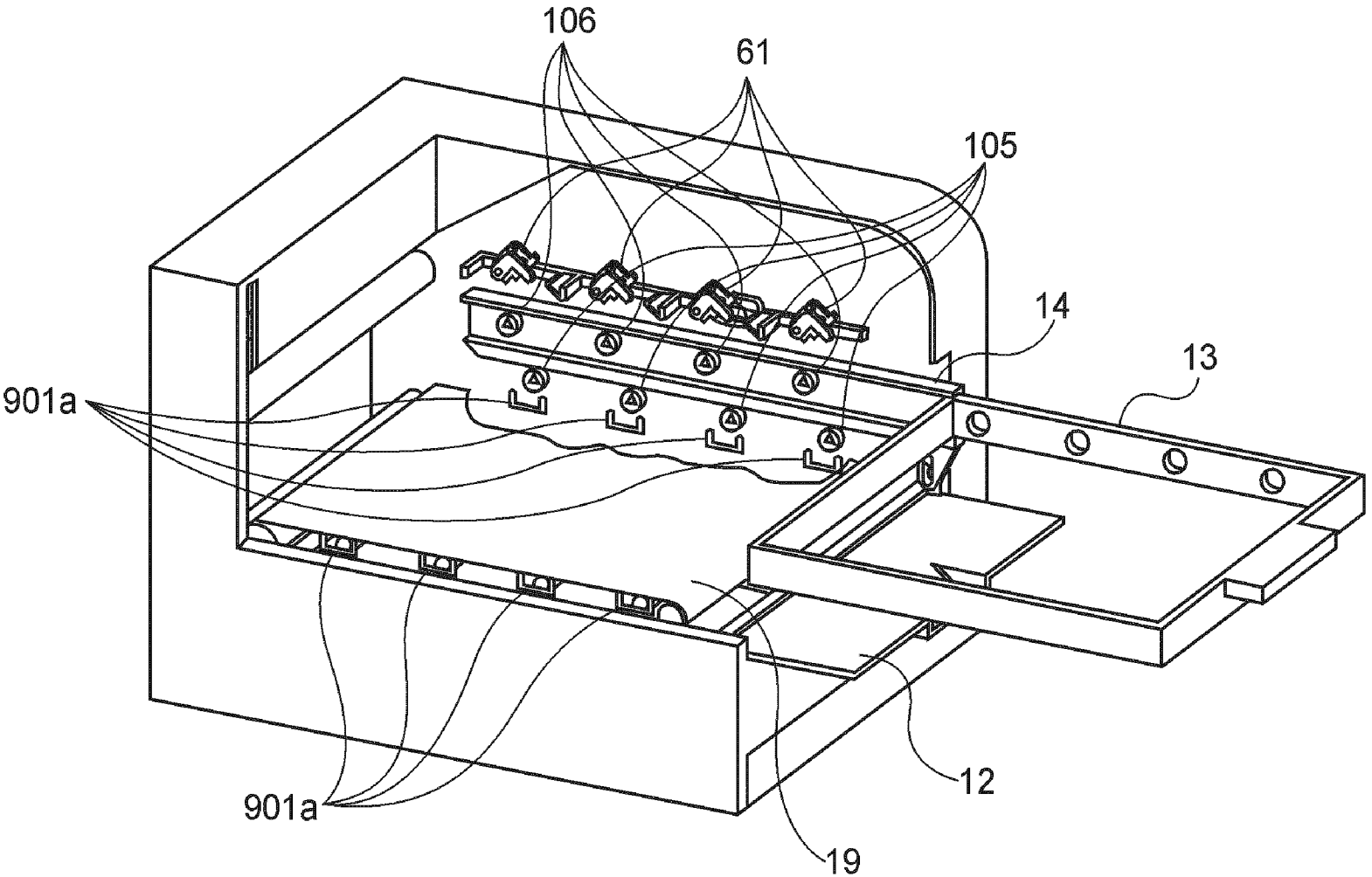
FIG. 42 is a partially cutaway perspective view of the electrophotographic image forming apparatus in the second embodiment of the present invention.

When it is necessary to take out any cartridge or cartridges in the apparatus main assembly 900, the door 12 is to be rotationally moved from the shut position to the open position. As the door 12 is rotationally moved, a pair of projections 15 (connective pins) with which the door 12 is provided moves in the clockwise direction about the rotational axis 12*a*, while moving in a pair of elongated holes 14*c*, with which the tray supporting members 14 are provided, one for one, from the bottom end 14*c*2 of the elongated hole 14*c* to the top end 14*c*1 of the elongated hole 14*c*, as shown in FIG. 38. As a result, the tray supporting members 14 are moved by the projections 15 in the direction indicated by an arrow mark z1. As the tray supporting members 14 are moved in the above-mentioned direction, the projections 14*d*1 and 14*d*2, which project from each of the tray supporting members 14 are guided by the guiding holes 107 with which the apparatus main assembly 900 is provided. Referring to FIG. 26, each guiding hole 107 has three sections, that is, two horizontal sections 107*a*1 and 107*a*3, and one diagonal section 107*a*2. The diagonal section 107*a*2 extends diagonally upward from the horizontal section 107*a*1 to the horizontal section 17*a*3. Therefore, as the door 12 is moved to the open position, as shown in FIG. 38, the projections 14*d*1 and 14*d*2 are guided by the guiding hole 107, sequentially through the horizontal section 107*a*1, diagonal section 107*a*2, and horizontal section 107*a*3. Thus, the tray supporting members 14 are first moved in the direction indicated by the arrow mark z1, and then, are moved in the direction indicated by an arrow mark y1, that is, the direction to move away from the transfer belt 19. With the tray supporting members 14 moved all the way in the direction indicated by the arrow mark y1, the cartridge tray 13 can be pulled out of the apparatus main assembly 900 through the opening 80 in the direction indicated by an arrow mark D2, as shown in FIG. 39. FIG. 42 is a partially cutaway perspective view of the image forming apparatus after the cartridge tray 13 has been pulled out of the apparatus main assembly 900 to its outermost position.

Next, the case in which any cartridge or cartridges are mounted into the apparatus main assembly 900 will be described. Referring to FIG. 39, the cartridge tray 13 is to be pushed into the apparatus main assembly 900 in the direction of the arrow mark D2 through the opening 80, with the door 12 kept in the open position. Thereafter, the door 12 is to be moved into the shut position as shown in FIG. 37. As the door 12 is moved, each of the projections 15 of the door 12 moves in the counterclockwise direction about the rotational axis 12*a*, while moving in the corresponding elongated hole 14*c* of the tray supporting member 14, to the bottom end 14*c*2 of the elongated hole 14*c*, as shown in FIG. 37. Thus, the tray supporting member 14 is moved in the direction of an arrow mark z2 by the pair of projections 15. Thus, as the door 12 is moved into the shut position as shown in FIG. 37, the projections 14*d*1 and 14*d*2 are guided by the guiding hole 107, that is, the horizontal section 107*a*3, diagonal section 107*a*2, and horizontal section 107*a*1, in the listed order. Therefore, the tray supporting members 14 move, first, in the direction of the arrow mark z2, and then, in the direction of the arrow mark y2, that is, the direction to move closer to the transfer belt 19.

{Positioning of Process Cartridge Relative to Main Assembly of Electrophotographic Image Forming Apparatus}

Figure 41:
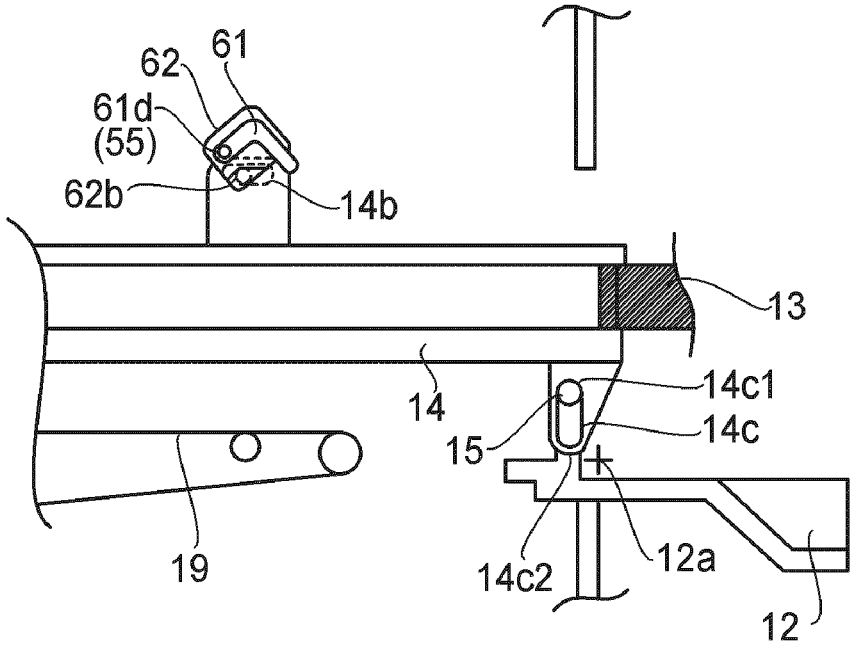
FIGS. 41 (*a*) and 41 (*b*) are a schematic drawing of the force applying second member in the second embodiment of the present invention, showing the operation of the force applying second member.
Figure 41:
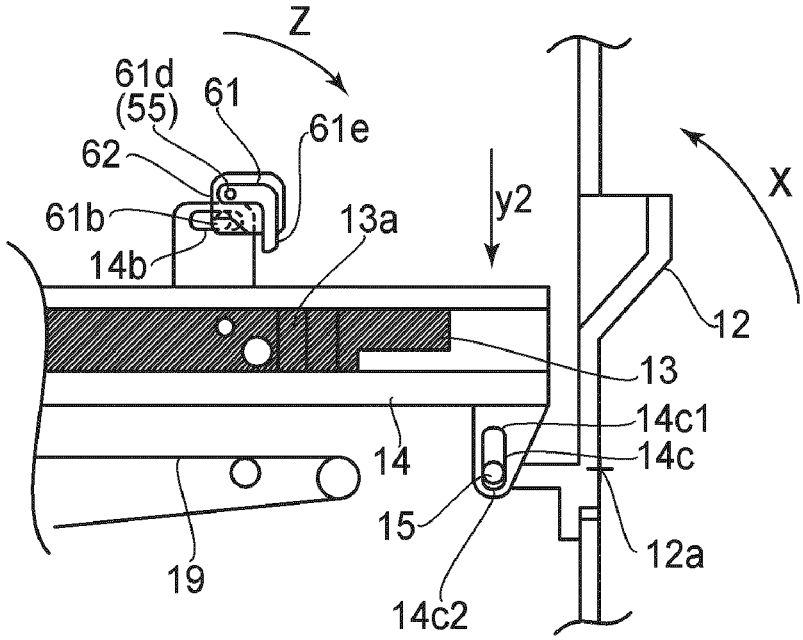

Next, referring to FIGS. 31, 35, 36, 41, and 42, the positioning of the cartridge 950 (950*y*, 950*m*, 950*c*, and 950*k*) in the apparatus main assembly 900 will be described. Referring to FIG. 42, the apparatus main assembly 900 is provided with multiple pairs (four pairs in this embodiment) of cartridge positioning portions 901*a* for positioning a cartridge 950 relative to the apparatus main assembly 900. That is, each cartridge compartment of the cartridge tray 13 is provided with a pair of cartridge positioning portions 901*a*, which are located at the lengthwise ends of the corresponding compartment, one for one, in terms of the direction parallel to the lengthwise direction of the cartridge 950, in a manner to sandwich the transfer belt 19. Referring to FIGS. 41(*a*) and 41(*b*), the main assembly 900 is also provided with force applying second members 61, which are located above the tray supporting members 14. Each force applying second member 61 is provided with a hole 61*d*, through which a force applying second member supporting shaft 55, with which the apparatus main assembly 900 is provided, is put to rotatably support the force applying second member 61.

At this time, the mechanism for moving the force applying second member 61 by using the movement of the door 12 will be described. The force applying second member 61 is connected to a connective member 62, which is for moving the force applying second member 61 by utilizing the movement of the door 12. The connective member 62 is provided with a hole, in which the supporting shaft 55 is fitted, and a supporting pin 62*b*, which fits in an elongated hole 14*b* (FIG. 41(*b*)) of the tray supporting member 14. Referring to FIG. 41, as the door 12 is moved from the open position to the shut position, the tray supporting member 14 moves in the direction indicated by the arrow mark y2 (FIG. 41), whereby the supporting pin 62*b* in the elongated hole 14*b* is forced to move also in the direction indicated by the arrow mark y2. As a result, the connective member 62 is rotationally moved about the supporting pin 62*b* in the elongated hole 14*b* in the direction indicated by an arrow mark Z (FIG. 41).

This movement of the connective member 62 which is in connection to the force applying second member 61 causes the pressing portion 62*e*, with which the connective member 62 is provided, to press on the force receiving surface 31*a*, which is a part of the top surface of the drum unit frame 34. Therefore, the cartridge 950*y* moves in the direction (downward) indicated by the arrow mark y2 in FIG. 41(*b*), causing the cartridge positioning portion 931*b* (FIG. 7), with which the drum unit 931*y* is provided, to come into contact with the cartridge positioning portion 901*a* with which the apparatus main assembly 900 is provided. As a result, the cartridge 950*y* is properly positioned relative to the apparatus main assembly 900 (FIG. 6).

The other cartridges 950*m*, 950*c*, and 950*k* also are properly positioned relative to the apparatus main assembly 900 in the same manner as the cartridge 950*y* is positioned as described above.

Figure 35:
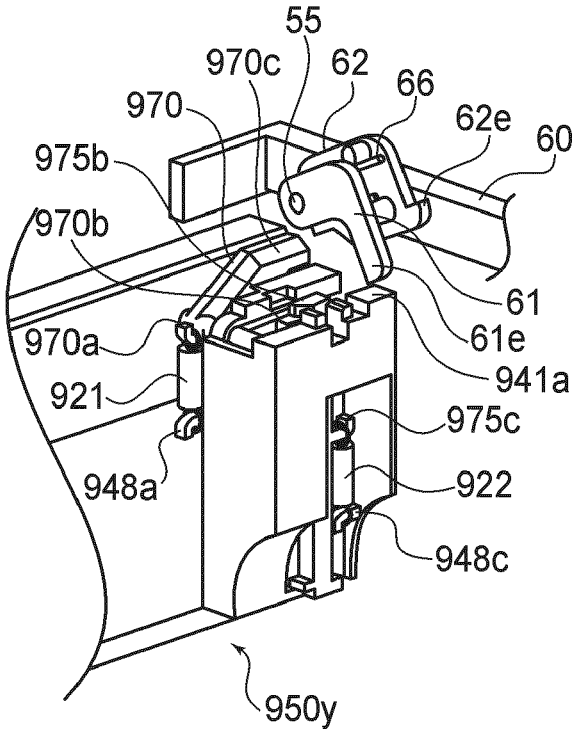
FIG. 35 is a schematic perspective view of the force applying second member, and force receiving member of the process cartridge in the second embodiment of the present invention, showing the operations thereof.
Figure 36:
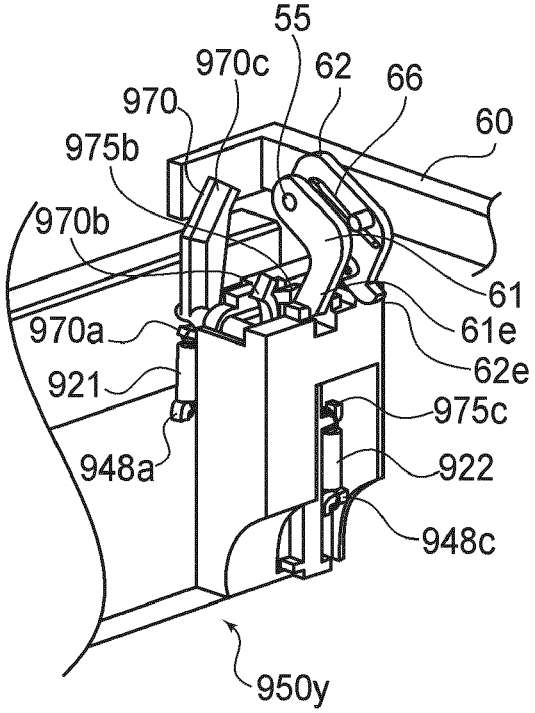
FIG. 36 also is a schematic perspective view of the force applying second member, and force receiving member of the process cartridge in the second embodiment of the present invention, showing the operations thereof.

Referring to FIGS. 35 and 36, the cartridge 950*y* is provided with a spring 66, which is between the force applying second member 61 and connective member 62. The spring 66 is supported by the supporting shaft 55, and is in contact with the pressing portion 62*e* of the connective member 62, and the projection 61*e* of the force applying second member 62. Incidentally, the apparatus main assembly 900 may be structured so that this spring 66 directly presses on the force receiving surface of the drum unit frame.

{Operation of Force Applying Member}

Next, referring to FIGS. 43 and 44, the operation of the force applying first member 60 will be described.

Driving force is transmitted from a motor 110, which is a mechanical driving force source with which the apparatus main assembly 900 is provided, to the gear 112 through a gear 111, as it is in the first embodiment. As the driving force is transmitted to the gear 112, the gear 112 rotates in the direction indicated by an arrow mark L, rotating thereby the cam portion 112*a*, which is integral with the gear 112, also in the direction indicated by the arrow mark L direction. The cam portion 112*a* is in contact with the moving force receiving portion 60*b*, with which the force applying first member 60 is provided. Therefore, as the cam portion 112*a* rotates, the force applying first member 60 is moved in the direction indicated by an arrow mark E or B.

Figure 33:
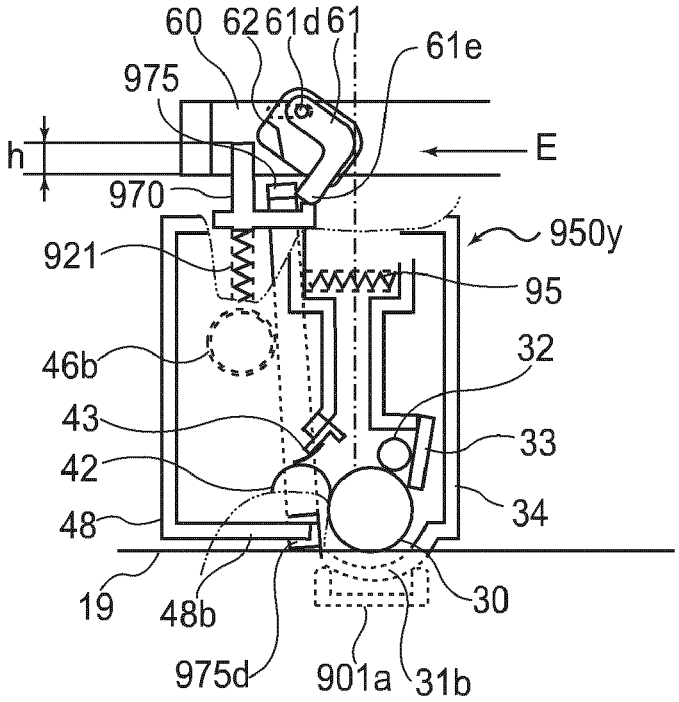
FIG. 33 is a schematic sectional view of one of the process cartridges, and its adjacencies, in the electrophotographic image forming apparatus in the second embodiment of the present invention, at a plane perpendicular to the axial line of the photosensitive drum.
Figure 34:
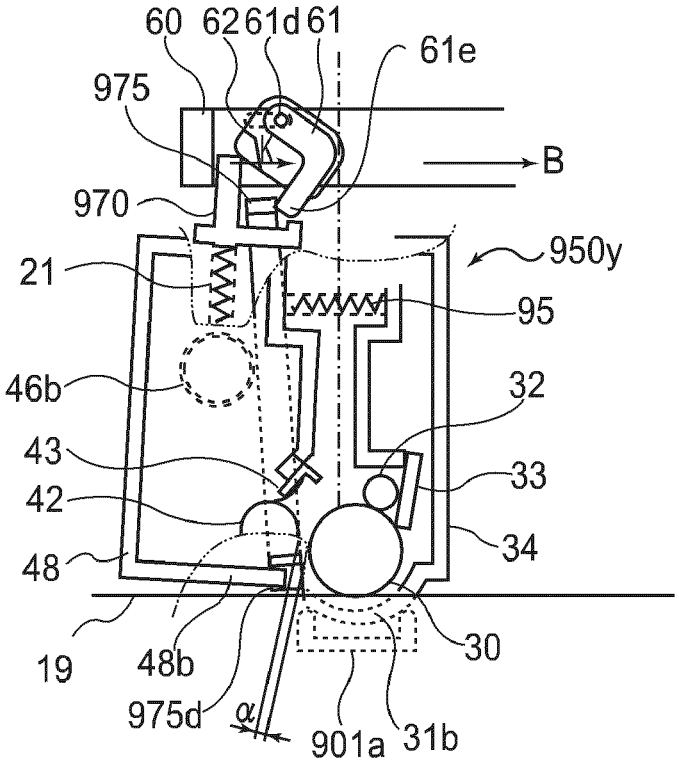
FIG. 34 is a schematic sectional view of one of the process cartridges, and its adjacencies, in the electrophotographic image forming apparatus in the second embodiment of the present invention, at a plane perpendicular to the axial line of the photosensitive drum.
Figure 43:
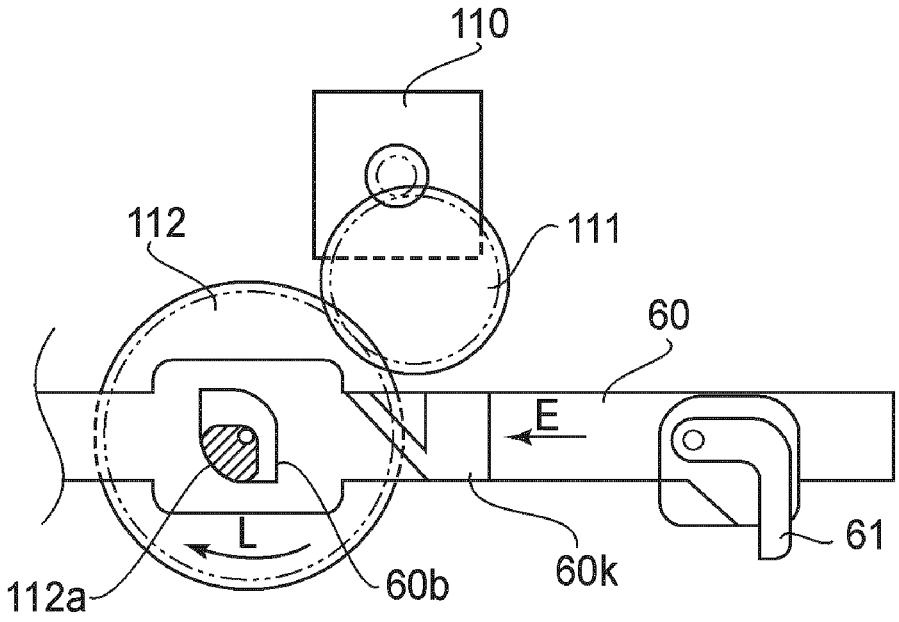
FIG. 43 is a schematic drawing of the force applying first member in the second embodiment of the present invention, showing the operation of the force applying first member.
Figure 44:
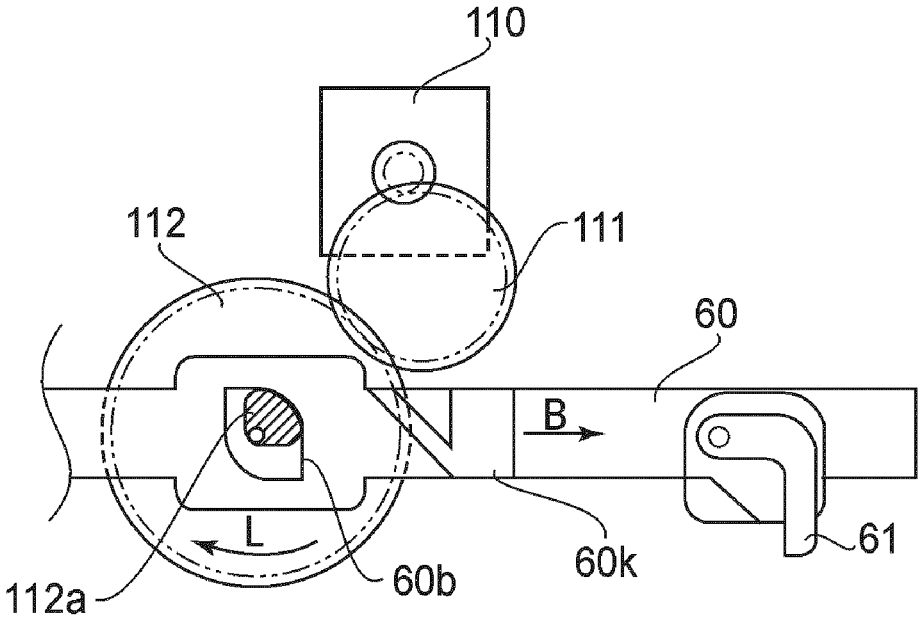
FIG. 44 also is a schematic drawing of the force applying first member in the second embodiment of the present invention, showing the operation of the force applying first member.

FIG. 43 shows the case in which the force applying first member 60 has been moved furthest in the direction indicated by the arrow mark E. In this case, the development roller 42 and photosensitive drum 30 is still in contact with each other (FIG. 33). FIG. 44 shows the case in which the force applying first member 60 has been moved furthest in the direction indicated by the arrow mark B. In this case, the force receiving member 70 is under the pressure from the rib 60*y*. As the force receiving member 70 is pressed by the rib 60*y*, it causes the development unit 941 to rotationally move about the rotational axis 946*b* (axle), causing thereby the development roller 42 to separate from the photosensitive drum 30 (FIG. 34). This position of the development unit 41 will be referred to as "separative position".

Figure 31:
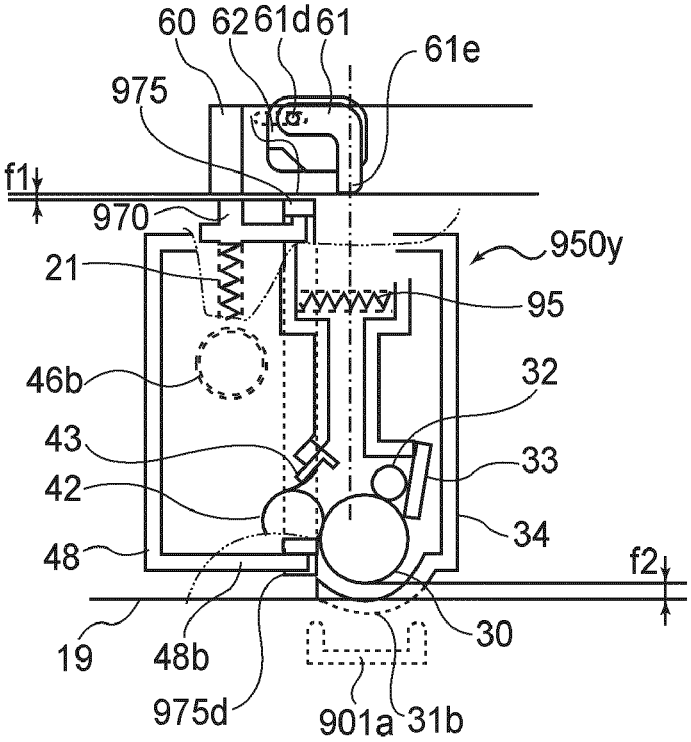
FIG. 31 is a schematic sectional view of one of the process cartridges, and its adjacencies, in the electrophotographic image forming apparatus in the second embodiment of the present invention, at a plane perpendicular to the axial line of the photosensitive drum.

While the cartridge 950 is moved into the apparatus main assembly 900, the force receiving member 970 remains in its standby position (FIG. 31). Therefore, the force applying first member 60 and force applying second member 61 can be positioned significantly closer to the cartridge path, without allowing them to interfere with the cartridge 50 during the mounting of the cartridge 50, compared to the counterparts of a conventional image forming apparatus, making it possible to minimize wasted space, making it thereby possible to significantly reduce the apparatus main assembly 900 in vertical dimension.

{Description of Mounting of Process Cartridge into Main Assembly of Electrophotographic Image Forming Apparatus, and Operation of Force Receiving Apparatus}

Next, the operational sequence from the beginning of the mounting of the cartridge(s) 950 into the apparatus main assembly 900, to the separation of the development roller 42 from the photosensitive drum 30, will be described.

Figure 40:
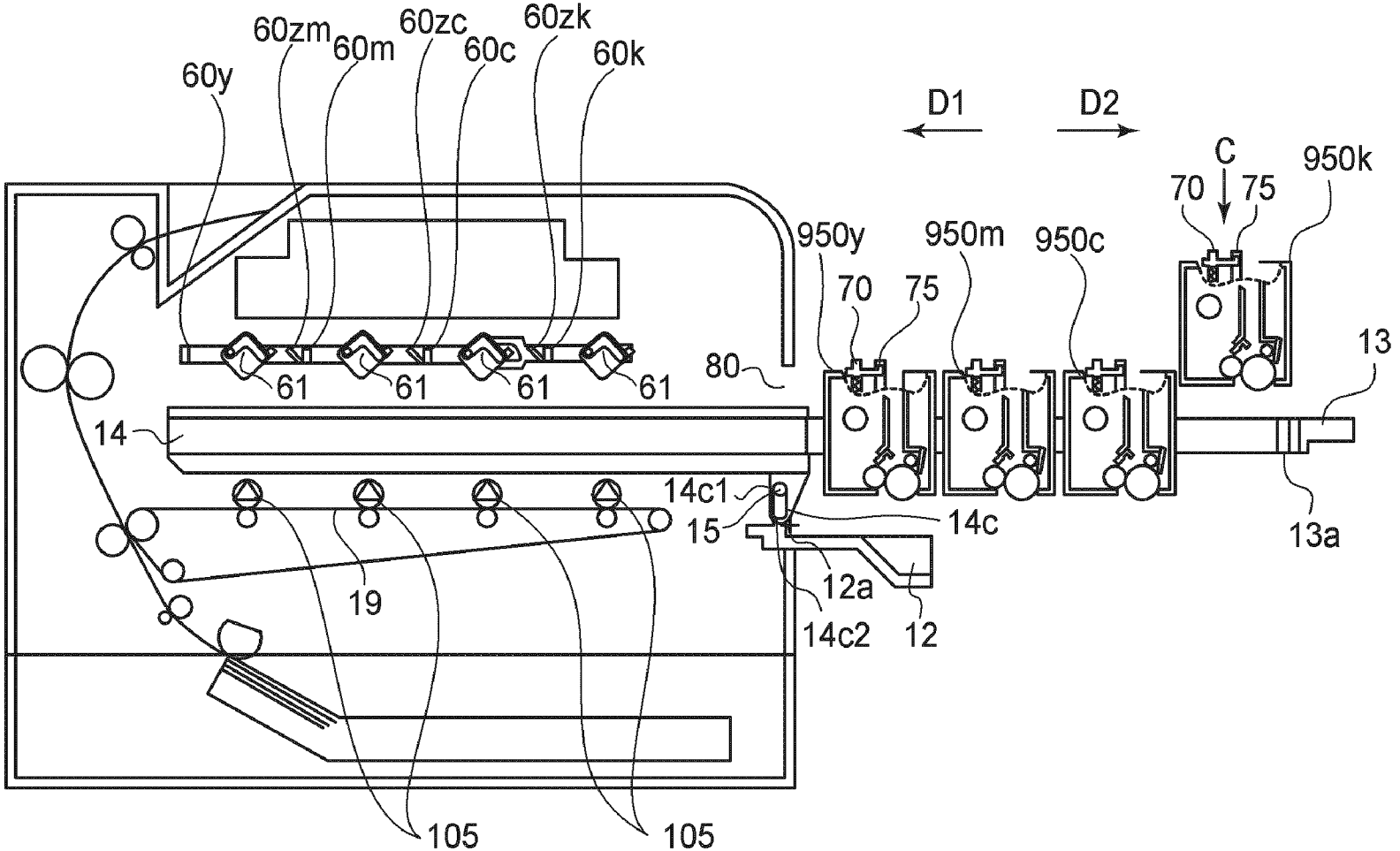
FIG. 40 is a schematic sectional view of the electrophotographic image forming apparatus in the second embodiment of the present invention, showing how the process cartridges therein are replaced.

Referring to FIG. 40, it is after the cartridge tray 13 is pulled out of the apparatus main assembly 900 to its outermost position that each cartridge 950 can be mounted into, or removed from, the cartridge tray 13 in the vertical direction indicated by the arrow mark C.

After the mounting of the cartridge(s) 950 into the cartridge tray 13, the cartridge tray 13 is to be moved into the apparatus main assembly 900 in the direction indicated by the arrow D1, through the opening 80. That is, in this embodiment, each cartridge 950 is horizontally moved into the apparatus main assembly 900, from the direction which is intersectional (roughly perpendicular) to the axial line of the photosensitive drum 30.

Referring to FIG. 40, the cartridge 950*y* is mounted most downstream in the cartridge tray 13 in terms of the direction in which the cartridge tray 13 is moved into the apparatus main assembly 900. That is, as the cartridge tray 13 is pushed into the apparatus main assembly 900, the cartridge 950*y* moves below the force applying second members 61*k*, 61*c*, and 61*m* (FIG. 39) which are to act on the other cartridges, that is, cartridge 950*m*, 960*c*, and 950*k*, respectively, and also, below the ribs 60*k*, 60*c*, and 60*m* of the force applying first member 60, from upstream to downstream.

Also in terms of the direction in which the cartridge tray 13 is moved into the apparatus main assembly 900, the cartridge 950*m* is mounted second from the downstream end of the cartridge tray 13. Thus, as the cartridge tray 13 is pushed into the apparatus main assembly 900, the cartridge 950*m* moves below the force applying second members 61*k*, and 61*c* (FIG. 39) which are to act on the other cartridges, that is, cartridge 950*c* and 950*k*, respectively, and also, below the ribs 60*k* and 60*c* of the force applying first member 60 from upstream to downstream.

Also in terms of the direction in which the cartridge tray 13 is moved into the apparatus main assembly 900, the cartridge 950*c* moves below the force applying second members 61*k* (FIG. 39) which is to acts on the 950*k*, and also, below the rib 60*k* of the force applying first member 60 from upstream to downstream.

Moreover, in terms of the direction in which the cartridge tray 13 is into the apparatus main assembly 900, the cartridge 950*k* is mounted most upstream. Thus, as the cartridge tray 13 is mounted into the apparatus main assembly 900, the cartridge 950*k* is moved far enough into the apparatus main assembly 900 for the force receiving member 970 to move below the force applying first member 61*k*, which is to acts on the cartridge 950*k*, from upstream to downstream.

Regarding this upstream to downstream movement of the force receiving member 970 below the force applying second member 61, the other cartridges, that is, the cartridges 950*y*, 950*m*, and 950*c*, are the same as the cartridge 950*k*.

That is, if the cartridge 950 were designed so that its force receiving member 970 remains projecting while the cartridge 950 is moved into the apparatus main assembly 900, the force applying second member 61 and force applying first member 60 would have to be positioned higher than where they are in this embodiment, in order to prevent the force receiving member 970 from interfering with the force applying second member 61 and force applying first member 60. In this embodiment, however, the cartridge 950 is designed so that the force receiving member 970 is kept in its standby position, that is, the position in which it does not project, the force applying second member 61 and force applying first member 60 can be positioned closer to the cartridge path, because the distance by which the force receiving member 970 projects does not need to be taken into consideration. In other words, designing the cartridge 950 so that its force receiving member 970 remains in its standby position while the cartridge 950 is mounted into the apparatus main assembly 900 makes it possible to reduce the apparatus main assembly 900 in its vertical dimension. Further, referring to FIGS. 31 and 32, in this embodiment, the force receiving member 970, force applying second member 61, and force applying first member 60 overlap in terms of the direction parallel to the axial line of the photosensitive drum 30, significantly reducing the cartridge 950 in dimension in terms of the direction perpendicular to its lengthwise direction.

Figure 32:
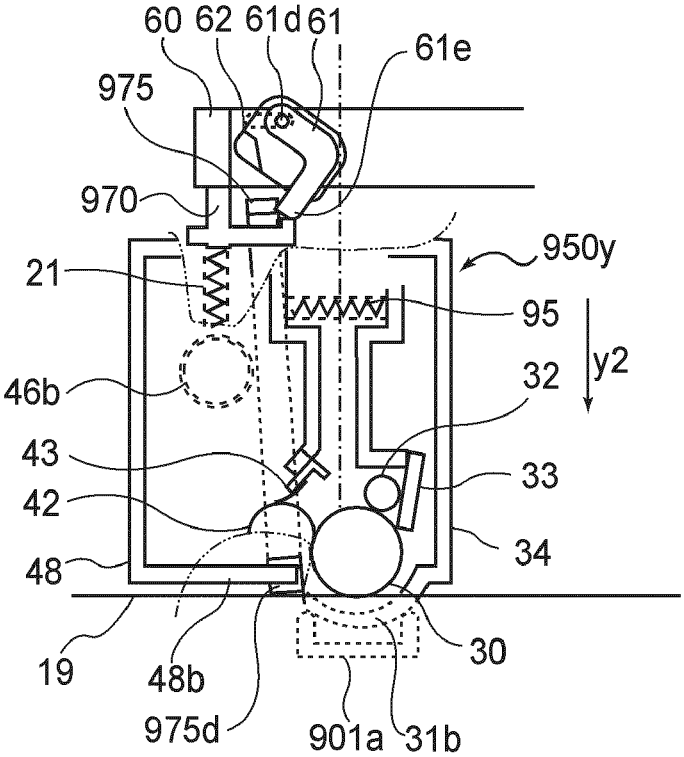
FIG. 32 is a schematic sectional view of one of the process cartridges, and its adjacencies, in the electrophotographic image forming apparatus in the second embodiment of the present invention, at a plane perpendicular to the axial line of the photosensitive drum.

Further, referring to FIGS. 31, 32, 35, and 36, the pressing portion 61*e* of the force applying second member 61 comes into contact with the contact portion 975*b* (FIGS. 32 and 36), and presses the contact portion 975*b*, when the contact portion 975*b* is in the first position (FIGS. 31 and 35). That is, it is when the contact portion 975*b* is in the first position that the contact portion 975*b* receives external force (second external force). As the pressing portion 61*e* presses on the contact portion 975*b*, the releasing member 975 is disengaged from the force receiving member 970, and the releasing member 975 moves to the second position (FIGS. 32 and 36). The force applying second member 61 in this embodiment is equivalent to the releasing member pushing member 102 in the first embodiment.

As the releasing member 975 is disengaged from the force receiving member 970, the force receiving member 970 rotates about the force receiving member supporting shaft, moving out of its standby position, that is, in such a manner that the contact portion 70*b* of the force receiving member 70 projects from the development unit 941, that is, in the direction to cause the contact portion 70*b* to move away from the rotational axis 946*b* of the development unit 41 (active position). The image forming operation which occurs thereafter is the same as that in the first embodiment, and therefore, will not be described here.

Next, the operation for removing the cartridges 950 from the apparatus main assembly 900 will be described.

As the door 12 is moved from the shut position to the open position, the force applying second member 61 rotates from the position shown in FIGS. 32 and 36 to the position shown in FIGS. 31 and 35. With this movement of the force applying second member 61, the pressure having been kept on the releasing member 975 by the force applying second member 61 is removed. However, the force receiving member 970 is kept in the protrusive position by the resiliency of the spring 921, as shown in FIG. 33. Referring to FIG. 36, the force receiving member 970 is provided with a contact portion 970*c* having a slant surface which is located opposite from the lateral surface by which the force receiving member 970 receives force from the force applying first member 60. Thus, as the cartridge tray 13 is pulled out in the direction indicated by the arrow mark D2 in FIG. 39, the force receiving member 970, which is in the protrusive position as is the force receiving member 70 in the first embodiment, comes into contact with the force receiving member returning member 60*zm*, 60*zcy*, and 60*zk*, with which the force applying first member 60, and is pushed down, being allowed to pass by the ribs 60*m*, 60*c*, and 60*k*, enabling thereby the cartridge 950*y* to be moved out of the apparatus main assembly 900 through the opening 80.

As described above, the cartridge 950 is structured so that it is when the door 12 is moved to the shut position after the cartridges 950 are mounted into the apparatus main assembly 900, that the contact portion 970*b* of the force receiving member 970 for moving the development unit 941 projects outward from the development unit 941. Therefore, the cartridge 950 is significantly smaller in vertical dimension than a conventional cartridge. Further, when the cartridge 950 is mounted into the apparatus main assembly 900, the force receiving member 970 remains in the standby position. Therefore, the cartridge path in the apparatus main assembly 900 can be less in vertical dimension than the cartridge path of the main assembly of a conventional electrophotographic image forming apparatus, and so is the opening 80 than the opening of the apparatus main assembly of a conventional electrophotographic image forming apparatus. Further, the force applying first member 60 can be positioned closer to the cartridge path, making it possible to reduce the apparatus main assembly 900 in vertical dimension.

Further, when the cartridge 950 is outside the apparatus main assembly 900, the force receiving member 970 remains in the standby position. Therefore, the force receiving member 970 is unlikely to be damaged while the cartridge 950 is handled by a user, or is transported alone.

According to the present invention, it is possible to reduce in size a process cartridge, the electrophotographic photosensitive drum and development roller of which can be placed in contact with each other, or separated from each other, and also, to reduce in size an electrophotographic image forming apparatus which employs the above described process cartridge. Further, it is possible to structure the above described process cartridge so that when the cartridge is transported alone, its force receiving member for separating the development roller from the electrophotographic photosensitive drum is unlikely to be damaged.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 172743/2007 and 162312/2008 filed Jun. 29, 2007 and Jun. 20, 2008, respectively, which are hereby incorporated by reference.

What is claimed is:

1. A process cartridge comprising:

an electrophotographic photosensitive drum;

a developing roller configured to develop an electrostatic latent image formed on said electrophotographic photosensitive drum;

a drum frame supporting said electrophotographic photosensitive drum;

a developing frame supporting said developing roller, said developing roller being movable relative to said drum frame between a contacting position in which said developing roller is in contact with said electrophotographic photosensitive drum and a spacing position in which said developing roller is spaced from said electrophotographic photosensitive drum;

a force receiving member provided movably relative to said developing frame and configured to receive an external force, wherein said force receiving member is capable of taking an operating position for moving said developing frame from the contacting position to the spacing position by receiving the external force, and a stand-by position retracted from the operating position;

an urging portion configured to urge said force receiving member from the stand-by position toward the operating position; and an engaging portion configured to engage with said force receiving member to hold said force receiving member in the stand-by position against an urging force of said urging portion.

2. A process cartridge according to claim 1, wherein said engaging portion is disengaged from said force receiving member by receiving a second external force.

3. A process cartridge according to claim 2, wherein said engaging portion is provided on said developing frame.

4. A process cartridge according to claim 2, wherein said engaging portion is provided on said drum frame.

5. A process cartridge according to claim 1, further comprising a releasing member movable by a second external force to release engagement between said engaging portion and said force receiving member.

6. A process cartridge according to claim 5, wherein said engaging portion is integral with said releasing member.

7. A process cartridge according to claim 6, wherein said releasing member is provided movably on said developing frame.

8. A process cartridge according to claim 1, further comprising a gear for receiving a driving force from the main assembly of the apparatus to rotate, by which said engaging portion is moved to disengage from said force receiving member, when said process cartridge is mounted to said main assembly of the apparatus.

9. A process cartridge according to claim 1, wherein said engaging portion is urged in a direction for engagement with said force receiving member to hold said force receiving member in the stand-by position.

10. A process cartridge according to claim 1, wherein said force receiving member receives the external force from a force applying member provided movably in the main assembly of the apparatus when said process cartridge is mounted to the main assembly of the apparatus.

11. A process cartridge according to claim 10, wherein said force receiving member is provided with a contact portion for contacting to the main assembly of the apparatus to move said force receiving member from the operating position toward the stand-by position.

12. A process cartridge according to claim 11, wherein said contact portion is disposed in a side opposite a side of receiving the force from the force applying portion with respect to a mounting direction in which said process cartridge is mounted to the main assembly of the apparatus.

13. A process cartridge according to claim 1, wherein said drum frame and said developing frame are rotatable relative to each other about a rotation axis, and said force receiving member is more remote from the rotation axis in the operating position than in the stand-by position.

14. A process cartridge according to claim 1, wherein said drum frame supports rotatably said photosensitive drum by way of a covering member.

15. A process cartridge according to claim 1, wherein said developing frame supports rotatably said developing roller by way of a bearing.

16. An electrophotographic image forming apparatus for forming an image on a recording material, said apparatus comprising:

(i) a movable force applying member;

(ii) mounting portion;

(iii) a process cartridge detachably mountable to said mounting portion, said process cartridge including:

an electrophotographic photosensitive drum, a developing roller configured to develop an electrostatic latent image formed on said electrophotographic photosensitive drum, a drum frame supporting said electrophotographic photosensitive drum, a developing frame supporting said developing roller, said developing roller being movable relative to said drum frame between a contacting position in which said developing roller is in contact with said electrophotographic photosensitive drum and a spacing position in which said developing roller is spaced from said electrophotographic photosensitive drum, a force receiving member provided movably relative to said developing frame and configured to receive an external force from said movable force applying member when said movable force applying member moves, wherein said force receiving member is capable of taking an operating position for moving said developing frame from the contacting position to the spacing position by receiving the external force, and a stand-by position retracted from the operating position, an urging portion configured to urge said force receiving member from the stand-by position toward the operating position, and an engaging portion configured to engage with said force receiving member to hold said force receiving member in the stand-by position against an urging force of said urging portion, and (iv) feeding portion configured to feed the recording material.

17. An apparatus according to claim 16, further comprising a gear for receiving a driving force from a main assembly of the apparatus to rotate, when said process cartridge is mounted to the main assembly of the apparatus, by which said engaging portion is moved to disengage from said force receiving member, when said process cartridge is mounted to said main assembly of the apparatus.

18. An apparatus according to claim 16, further comprising a force applying portion, wherein said engaging portion contacts to said force applying portion to receive a second external force from said force applying portion, by which said engaging portion is moved to disengage from said force receiving member.

19. An apparatus according to claim 16, further comprising a force applying portion, wherein said process cartridge further comprises a releasing member configured to contact to said force applying portion to receive a second external force from said force applying portion, thus releasing engagement between said engaging portion and said force receiving member, when said process cartridge is mounted to said mounting portion.

20. An apparatus according to claim 16, wherein said force receiving member is provided with a contact portion configured to contact said movable force applying member to move said force receiving member from the operating position toward the stand-by position, when said process cartridge is dismounted from said mounting portion.

21. An apparatus according to claim 20, wherein said contact portion is disposed in a side opposite a side of receiving the force from said movable force applying member with respect to a direction in which said process cartridge is dismounted from said mounting portion.

22. An apparatus according to claim 16, further comprising an opening through which said process cartridge passes, wherein said process cartridge is detachably mountable to said mounting portion through the opening in a substantially horizontal direction crossing with an axial direction of said electrophotographic photosensitive drum.

23. An apparatus according to claim 22, wherein said force receiving member permits said process cartridge to pass through the opening in the stand-by position, and said force receiving member moves from the stand-by position to the operating position when said process cartridge is mounted to said mounting portion.

24. An apparatus according to claim 16, further comprising a drawer member movable between first position in which said processing cartridge is mounted to said mounting portion and a second position in which said process cartridge is mountable to and dismountable from said drawer member.

* * * * *